US009495823B2

(12) United States Patent
LaCroix-Toyne et al.

(10) Patent No.: US 9,495,823 B2
(45) Date of Patent: Nov. 15, 2016

(54) VENDING APPARATUS AND METHOD

(75) Inventors: Nancy LaCroix-Toyne, Tujunga, CA (US); Raffi Mekhitarian, Shadow Hills, CA (US); Dikran Babikian, Glendale, CA (US); Jacobus Marcus Berkhout, Menlo Park, CA (US); Robert Riccomini, Saratoga, CA (US); William Conway, Moorpark, CA (US); Peter Hues, San Jose, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 644 days.

(21) Appl. No.: 12/829,366

(22) Filed: Jul. 1, 2010

(65) Prior Publication Data

US 2011/0000760 A1 Jan. 6, 2011

Related U.S. Application Data

(60) Provisional application No. 61/270,071, filed on Jul. 1, 2009, provisional application No. 61/270,432, filed on Jul. 7, 2009.

(51) Int. Cl.
*G07F 5/00* (2006.01)
*G07F 11/00* (2006.01)
(Continued)

(52) U.S. Cl.
CPC ..... *G07F 11/24* (2013.01); *G07F 5/00* (2013.01); *G07F 5/02* (2013.01); *G07F 5/04* (2013.01);
(Continued)

(58) Field of Classification Search
CPC ..... G07F 5/00; G07F 5/02; G07F 5/04; G07F 5/06; G07F 5/08; G07F 5/10; G07F 5/12; G07F 5/14; G07F 5/16; G07F 5/18; G07F 5/20; G07F 5/22; G07F 5/24; G07F 5/26; G07F 11/00; G07F 13/00; G07F 13/02
USPC ..... 194/225–227, 232–239, 247, 256, 257, 194/268–275, 279, 284–286, 289, 297, 299, 194/300; 453/46, 47, 53, 54
See application file for complete search history.

(56) References Cited

U.S. PATENT DOCUMENTS 441,536 A 11/1890 Cornell
1,096,353 A 5/1914 Coe et al.
(Continued)

FOREIGN PATENT DOCUMENTS

DE 20 2004 014 478 U1 2/2005
EP 1 837 834 A1 9/2007

OTHER PUBLICATIONS

Invitation to Pay Additional Fees dated Sep. 6, 2010, for International Application No. PCT/US2010/040846, filed Jul. 1, 2010.
(Continued)

*Primary Examiner* — Jeffrey Shapiro
(74) *Attorney, Agent, or Firm* — Lewis Roca Rothgerber Christie LLP

(57) ABSTRACT

A vending apparatus and method of vending a product. Embodiments of a vending apparatus include a dispense mechanism configured to dispense a product, the dispense mechanism including a chamber that is rotatable relative to an opening of the dispense mechanism for aligning the product with the opening and dispensing the product therethrough. Further embodiments of a vending apparatus include a coin mechanism for receiving at least one coin before the vending apparatus dispenses a product, the coin mechanism including a delay mechanism configured to slow movement of an actuating device for avoiding jamming of the at least one coin in the coin mechanism.

13 Claims, 29 Drawing Sheets

(51) Int. Cl.

| | |
|---|---|
| ***G07F 13/00*** | (2006.01) |
| ***G07F 15/00*** | (2006.01) |
| ***G07F 17/00*** | (2006.01) |
| ***G07F 11/24*** | (2006.01) |
| ***G07F 5/04*** | (2006.01) |
| ***G07F 5/02*** | (2006.01) |
| ***G07F 5/06*** | (2006.01) |
| ***G07F 5/08*** | (2006.01) |
| ***G07F 5/10*** | (2006.01) |
| ***G07F 5/12*** | (2006.01) |
| ***G07F 5/14*** | (2006.01) |
| ***G07F 5/16*** | (2006.01) |
| ***G07F 5/18*** | (2006.01) |
| ***G07F 5/20*** | (2006.01) |
| ***G07F 5/22*** | (2006.01) |

(52) U.S. Cl.

CPC . *G07F 5/06* (2013.01); *G07F 5/08* (2013.01); *G07F 5/10* (2013.01); *G07F 5/12* (2013.01); *G07F 5/14* (2013.01); *G07F 5/16* (2013.01); *G07F 5/18* (2013.01); *G07F 5/20* (2013.01); *G07F 5/22* (2013.01); *G07F 11/00* (2013.01)

(56) References Cited

U.S. PATENT DOCUMENTS

| | | | | |
|---|---|---|---|---|
| 1,621,619 | A | 3/1927 | Ashe | |
| 1,852,733 | A * | 4/1932 | Brown | 312/35 |
| 2,348,434 | A | 5/1944 | Henry | |
| 2,671,546 | A * | 3/1954 | Weiler | 194/225 |
| 2,872,009 | A * | 2/1959 | Ridings et al. | 194/221 |
| 2,873,012 | A | 2/1959 | Lux | |
| 2,984,326 | A | 5/1961 | Westphal | |
| 2,993,581 | A * | 7/1961 | Holstein et al. | 194/227 |
| 3,095,997 | A * | 7/1963 | Garvin | 221/180 |
| 3,250,432 | A | 5/1966 | Green et al. | |
| 3,946,846 | A | 3/1976 | Pepiciello et al. | |
| 4,105,104 | A * | 8/1978 | Leonhart | 194/257 |
| 4,109,825 | A * | 8/1978 | Weitzman | 221/14 |
| 4,469,211 | A | 9/1984 | Shipman, Sr. | |
| 4,499,983 | A | 2/1985 | Gitlin et al. | |
| 4,550,819 | A * | 11/1985 | Smith | 194/218 |
| 4,591,042 | A | 5/1986 | Wenner | |
| 4,693,357 | A | 9/1987 | Aschenbeck et al. | |
| 4,726,457 | A | 2/1988 | Shteyngarts et al. | |
| 4,823,984 | A | 4/1989 | Ficken | |
| 5,167,345 | A | 12/1992 | Bleeker | |
| 5,176,287 | A | 1/1993 | Suris | |
| 5,199,598 | A | 4/1993 | Sampson | |
| 5,605,249 | A * | 2/1997 | Gonyea | 221/6 |
| 5,915,519 | A | 6/1999 | Glaser | |
| 6,050,447 | A * | 4/2000 | Kovens et al. | 221/125 |
| 6,929,110 | B2 | 8/2005 | Dobbins et al. | |
| 6,935,530 | B2 * | 8/2005 | Semeniuk | G07F 11/44 221/124 |
| 7,469,779 | B2 * | 12/2008 | Horian | G07F 1/047 194/232 |
| 7,793,769 | B2 * | 9/2010 | Kumabe et al. | 194/240 |
| 7,798,303 | B1 * | 9/2010 | Chang | 194/293 |
| 7,950,513 | B2 * | 5/2011 | Horian | G07F 1/047 194/232 |
| 2003/0042110 | A1 | 3/2003 | Wilfong | |
| 2004/0245067 | A1 * | 12/2004 | Jones | 194/327 |
| 2004/0262122 | A1 * | 12/2004 | Horian | G07F 1/047 194/247 |
| 2005/0045651 | A1 * | 3/2005 | Semeniuk | G07F 11/44 221/155 |
| 2009/0188770 | A1 * | 7/2009 | Horian | G07F 1/047 194/247 |
| 2011/0000760 | A1 * | 1/2011 | LaCroix-Toyne | G07F 11/24 194/350 |

OTHER PUBLICATIONS

The International Search Report and The Written Opinion of the International Search Authority dated Feb. 10, 2011 for International Application No. PCT/US2010/040846, Filed Jul. 1, 2010.

European Patent Office; Extended European Search Report dated Jun. 20, 2012, for European Application No. 12 15 5388.7; 8 Pages.

* cited by examiner

VENDING APPARATUS AND METHOD

CROSS-REFERENCE TO RELATED APPLICATION(S)

This application claims priority to and the benefit of U.S. Provisional Patent Application No. 61/270,071, filed on Jul. 1, 2009, and U.S. Provisional Patent Application No. 61/270,432, filed on Jul. 7, 2009, the entire content of each of which is incorporated herein by reference.

FIELD OF THE INVENTION

The present invention relates to vending machines, and more particularly to coin mechanisms and dispense mechanisms of vending machines.

BACKGROUND

Vending machines having coin mechanisms for operating such machines and dispense mechanisms for dispensing product are known in the art. Such vending machines are located in a variety of locations, often making the machines subject to weather extremes and abuse, such as fraudulent attempts to obtain product without inserting the required purchase price.

Some conventional coin mechanisms are complex and utilize electronic parts to actuate the coin mechanism. Other conventional coin mechanism designs are mechanically operated but employ a complex arrangement. Although such mechanisms may be versatile and perform well under ideal conditions, they are inherently expensive and prone to requiring frequent maintenance due to the harsh conditions under which vending machines sometimes operate.

Conventional coin mechanism designs that are mechanically operated typically require a user to turn a knob or rotate a lever to actuate the mechanism. Such modes of actuation are difficult or impossible for individuals with limited hand movement, such as individuals who suffer from arthritis or other debilitating conditions.

Additionally, conventional coin mechanisms of vending machines have a common problem of being susceptible to jamming. That is, coins may become lodged or sandwiched in the coin mechanism, thereby preventing dispensing of the product. Alternatively, a lodged coin may cause a dispense mechanism to remain activated, thereby allowing a user to take more of a product than was paid for, and possibly all of the product in the machine. Moreover, because coin jamming renders a vending machine inoperable, persistent coin jamming incurs additional maintenance costs and lost sales. Similarly, dispense mechanisms of many conventional vending machines are susceptible to product jamming, resulting in the above-described problems, or may sometimes dispense too little or no product, or possibly too much product.

SUMMARY

Aspects of embodiments of the present invention are directed to a vending apparatus and method of use embodying an improved coin mechanism for actuating the vending apparatus. Further aspects of embodiments of a vending apparatus according to the present invention include a coin mechanism having a non-complex design capable of withstanding harsh environments and user abuse. Aspects of embodiments of a vending apparatus according to the present invention also include a coin mechanism configured for simple actuation without requiring gripping or rotating of an actuator, such as a device compliant with the Americans with Disabilities Act (ADA). Further aspects of embodiments of a vending apparatus according to the present invention include a coin mechanism that is operable without electricity, such as in remote locations or in the event of a power failure. Aspects of embodiments of a vending apparatus according to the present invention further include a coin mechanism that is configured to prevent or substantially reduce jamming of coins between components or within a slot of the coin mechanism.

Aspects of embodiments of the present invention are also directed to a vending apparatus and method of use embodying an improved dispense mechanism for dispensing a product. Aspects of embodiments of a vending apparatus according to the present invention further include a dispense mechanism that is configured to prevent or substantially reduce jamming of a product in the vending apparatus.

According to one exemplary embodiment of the present invention, a vending apparatus includes a coin mechanism including a coin slot formed between two moveable joined members, wherein at least one of the members has a contoured channel formed thereon. The contoured channel is configured to receive and guide at least one coin of a required denomination to a desired position aligned with an actuator opening on at least one of the members.

A user can actuate the coin mechanism to dispense a product by actuating an actuator. The actuator causes an actuation member to travel through the actuator opening of the one member, engage a coin against the surface of the other member, and displace the two members together. One or both of the members are connected to a product delivery system ("dispense mechanism"), which is configured to deliver a desired product upon displacement of the channel member.

Embodiments of the coin mechanism of the present invention do not require complex electronic or mechanical parts. Additionally, embodiments of the coin mechanism of the present invention do not require the turning of a knob or rotation of a lever, minimizing the discomfort or pain suffered by individuals with limited hand movement during actuation of the coin mechanism.

Further, embodiments of the coin mechanism of the present invention have a coin channel, or coin guide, having a contoured shape configured to thwart fraudulent attempts to obtain the product by inserting, for example, an elongated flat object into the coin slot instead of the required coins.

According to one exemplary embodiment, a vending apparatus includes a dispense mechanism configured to dispense a product, the dispense mechanism including a chamber that is rotatable relative to an opening of the vending apparatus for aligning the product with the opening and dispensing the product therethrough.

According to one exemplary embodiment, a vending apparatus includes a coin mechanism for receiving at least one coin before the vending apparatus dispenses a product, the coin mechanism including a delay mechanism configured to slow movement of an actuating device for avoiding jamming of the at least one coin in the coin mechanism.

According to one exemplary embodiment, a vending apparatus includes a product receptacle for containing a product, a platform having an opening for discharging the product therethrough, and a dispense mechanism for dispensing the product, the dispense mechanism including a discharge chamber above the platform and having walls for receiving the product therebetween, the discharge chamber rotatable relative to the opening of the platform from a first position wherein the walls of the discharge chamber are substantially aligned with walls of the product receptacle and are not substantially aligned with edges of the opening to a second position wherein the walls of the discharge chamber are not substantially aligned with the walls of the product receptacle and are substantially aligned with the edges of the opening for allowing the product to drop through the opening. In one embodiment, the walls of the discharge chamber have a height that is less than a height of the product received in the discharge chamber, the height of the product being measured in a same direction as the height of the walls of the discharge chamber.

According to one exemplary embodiment, a vending apparatus includes a coin mechanism for receiving at least one coin before the vending apparatus dispenses a product, the coin mechanism including a first member and a second member defining a coin slot therebetween for receiving the at least one coin, the actuating device including an actuator moveable between an unactuated position and an actuated position for causing dispensing of the product, and the delay mechanism including a cam engageable with the first member for holding the first and second members in a first position, and a damper configured to slow a return of the actuator from the actuated position to the unactuated position. In one embodiment, the vending apparatus further includes an actuation lever releasably engageable with the actuator and including a damper engaging portion engageable with the damper for slowing movement of the actuation lever. In one embodiment, the actuation lever is configured to displace the first and second members from a first position to a second position when the actuator engages the actuation lever and is moved to the actuated position, and wherein the cam prevents the first and second members from returning toward the first position until the cam is released by the actuation lever after the at least one coin drops into a coin bank of the vending apparatus. In one embodiment, the coin mechanism further includes a ratchet mechanism including a rack of teeth on the actuator and a pawl releasably engageable with the rack of teeth, wherein the at least one coin is not droppable out of the coin slot and into a coin bank of the vending apparatus until the rack of teeth is moved past the pawl.

According to one exemplary embodiment, a vending apparatus includes a coin mechanism for receiving at least one coin before the vending apparatus dispenses a product, the coin mechanism including: a first member and a second member defining a coin slot therebetween for receiving the at least one coin; an actuator moveable between an unactuated position and an actuated position and configured to displace the first and second members from a first position to a second position when moved to the actuated position; and a delay mechanism configured to slow a return of the first and second members toward the first position after the actuator has moved to the actuated position for avoiding jamming of the at least one coin in the coin mechanism, the delay mechanism including a cam and a damper.

According to one exemplary embodiment, a vending apparatus includes a product receptacle for containing a product; a coin mechanism for receiving at least one coin before the vending apparatus dispenses the product, the coin mechanism including a first member and a second member defining a coin slot therebetween for receiving the at least one coin, an actuator moveable between an unactuated position and an actuated position for causing dispensing of the product, and a delay mechanism configured to slow a return of the actuator from the actuated position to the unactuated position for avoiding jamming of the at least one coin in the coin mechanism, the delay mechanism including a cam and a damper; and a dispense mechanism for dispensing the product, the dispense mechanism including a platform having an opening for discharging the product therethrough; and a discharge chamber above the platform and having walls for receiving the product therebetween, the discharge chamber rotatable relative to the opening of the platform from a first position wherein the walls of the discharge chamber are substantially aligned with walls of the product receptacle and are not substantially aligned with edges of the opening to a second position wherein the walls of the discharge chamber are not substantially aligned with the walls of the product receptacle and are substantially aligned with the edges of the opening for allowing the product to drop through the opening. In one embodiment, the discharge chamber is connected to one of the first and second members of the coin mechanism via a linkage and is rotatable relative to the platform via the linkage when the one of the first and second members is displaced.

According to one exemplary embodiment, a method of vending a product utilizing a vending apparatus having a product receptacle for containing the product, and a dispense mechanism for dispensing the product, the dispense mechanism including a platform having an opening for discharging the product therethrough, and a discharge chamber above the platform and having walls for receiving the product therebetween, includes rotating the discharge chamber relative to the opening of the platform from a first position wherein the walls of the discharge chamber are substantially aligned with walls of the product receptacle and are not substantially aligned with edges of the opening to a second position wherein the walls of the discharge chamber are not substantially aligned with the walls of the product receptacle and are substantially aligned with the edges of the opening for allowing the product to drop through the opening.

According to one exemplary embodiment, a method of vending a product utilizing a vending apparatus having a coin mechanism for receiving at least one coin before the vending apparatus dispenses the product and including a first member and a second member defining a coin slot therebetween for receiving the at least one coin, an actuator moveable between an unactuated position and an actuated position for causing dispensing of the product, and a delay mechanism configured to slow a return of the actuator from the actuated position to the unactuated position, the delay mechanism including a cam and a damper, includes: moving the actuator from the unactuated position to the actuated position for dispensing the product from the vending apparatus when the at least one coin is inserted into the slot; and slowing the return of the actuator from the actuated position to the unactuated position utilizing the delay mechanism for avoiding jamming of the at least one coin in the coin mechanism.

According to one exemplary embodiment, a method of vending a product utilizing a vending apparatus having a product receptacle for containing the product; a coin mechanism for receiving at least one coin before the vending apparatus dispenses the product and including a first member and a second member defining a coin slot therebetween for receiving the at least one coin, an actuator moveable between an unactuated position and an actuated position for causing dispensing of the product, and a delay mechanism configured to slow a return of the actuator from the actuated position to the unactuated position, the delay mechanism including a cam and a damper; and a dispense mechanism for dispensing the product, the dispense mechanism including a platform having an opening for receiving the product therethrough, and a discharge chamber above the platform and having walls for receiving the product therebetween, includes: inserting the at least one coin into the coin slot; moving the actuator from the unactuated position to the actuated position, the delay mechanism slowing the return of the actuator from the actuated position to the unactuated position for avoiding jamming of the at least one coin in the coin mechanism; and rotating the discharge chamber relative to the opening of the platform from a first position wherein the walls of the discharge chamber are substantially aligned with walls of the product receptacle and are not substantially aligned with edges of the opening to a second position wherein the walls of the discharge chamber are not substantially aligned with the walls of the product receptacle and are substantially aligned with the edges of the opening for allowing the product to drop through the opening.

According to one exemplary embodiment, a method of vending a product held in a product receptacle of a vending apparatus includes rotating the product to align the product with a discharge opening of the vending apparatus whereby the product is dispensed through the discharge opening. In one embodiment, the method further includes stacking a plurality of products in the product receptacle to form a stack of the products stacked on top of one another, wherein the product being rotated is at the base of the stack of the products. In one embodiment, the product is dispensed through the discharge opening by gravity. In one embodiment, the method further includes dropping the product from the product receptacle into a discharge chamber before rotating the product, wherein rotating the product includes rotating the discharge chamber. In one embodiment, rotating the discharge chamber includes rotating the discharge chamber in a first direction to align the product with the discharge opening, rotating the discharge chamber in a second direction opposite the first direction subsequent to the product being dispensed through the discharge opening, and dropping another product from the product receptacle into the discharge chamber. In one embodiment, the discharge chamber is rotated in the second direction more rapidly than in the first direction.

Other features and advantages of embodiments of the present invention will become apparent from the following detailed description, taken in conjunction with the accompanying drawings which illustrate, by way of example, features and aspects of exemplary embodiments of the present invention.

DETAILED DESCRIPTION

Figure 1:
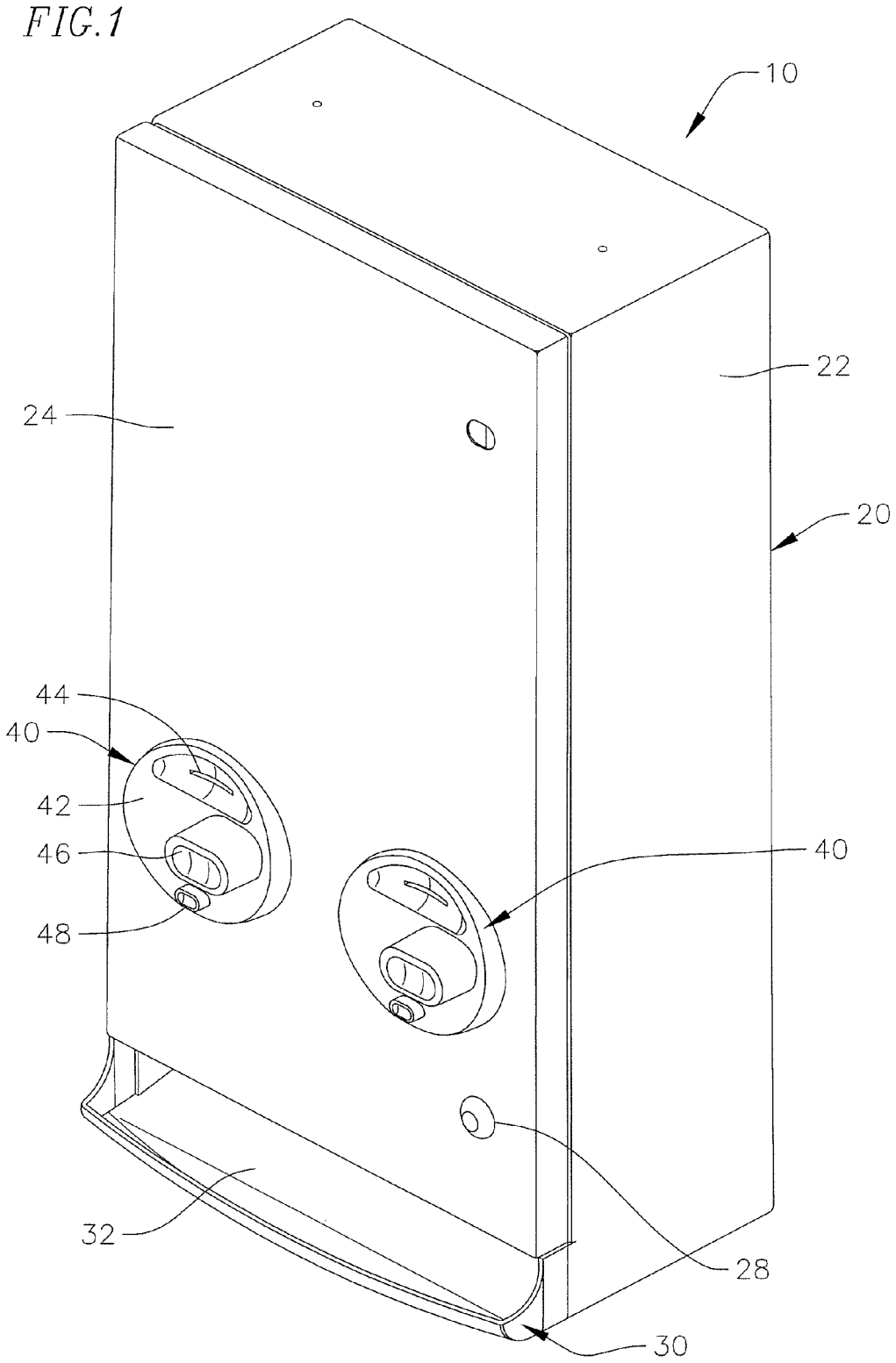
FIG. 1 is a perspective view of a vending apparatus according to an embodiment of the present invention.
Figure 2:
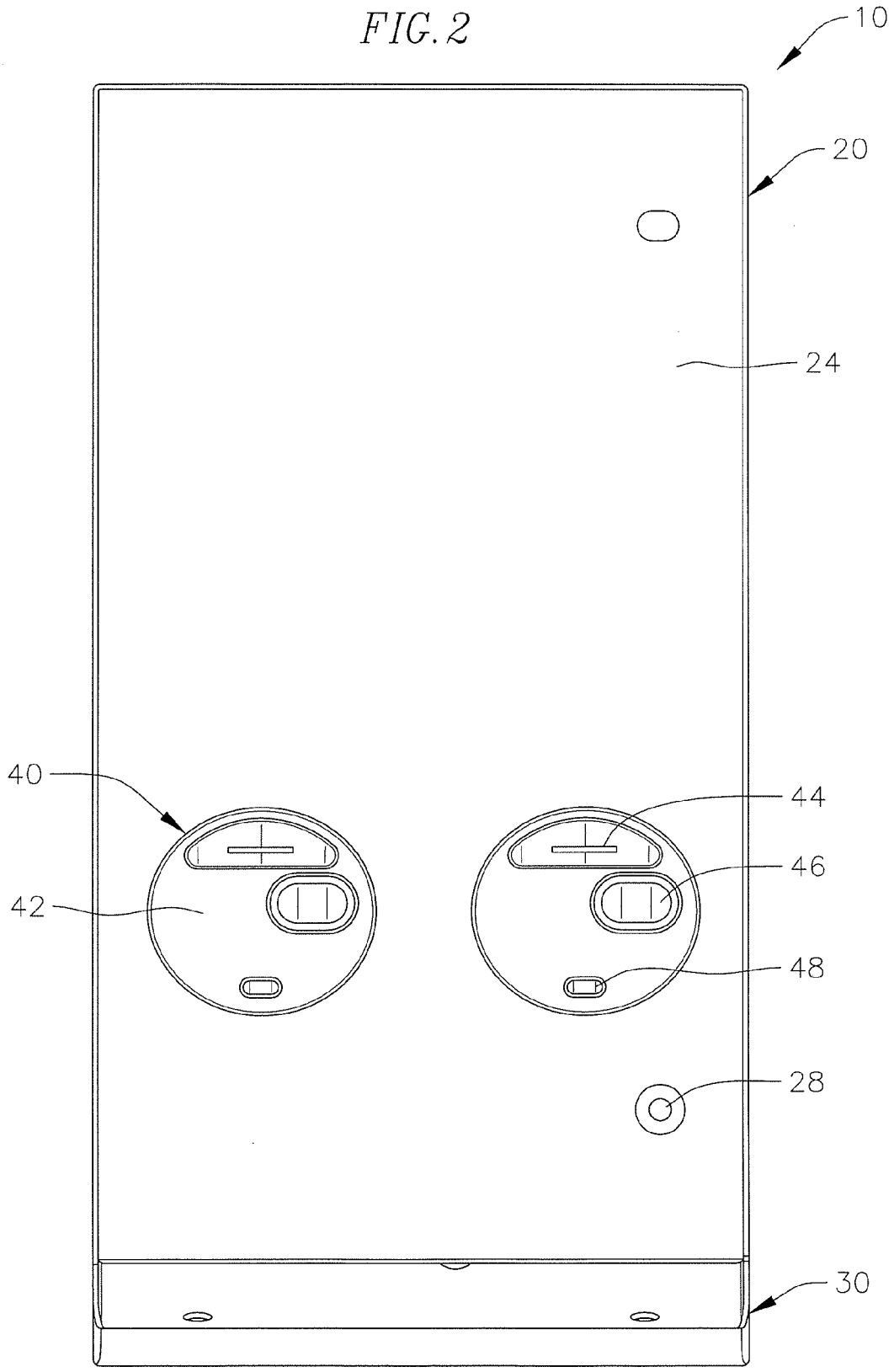
FIG. 2 is a front view of the vending apparatus of FIG. 1.
Figure 3:
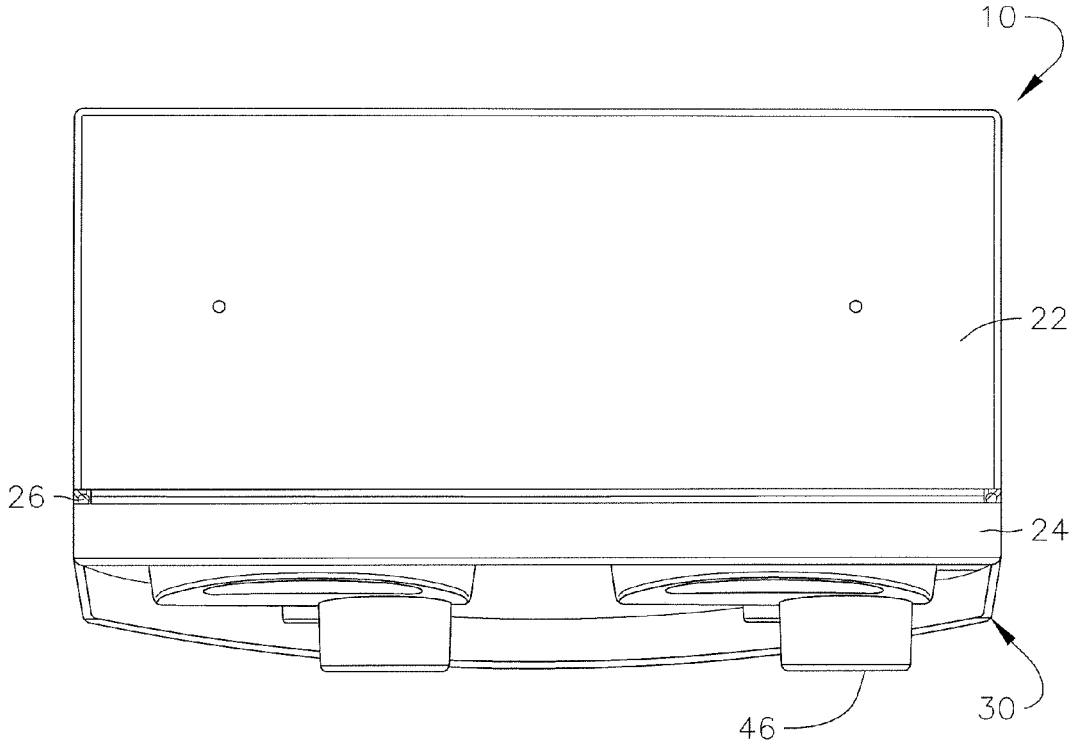
FIG. 3 is a top view of the vending apparatus of FIG. 1.
Figure 4:
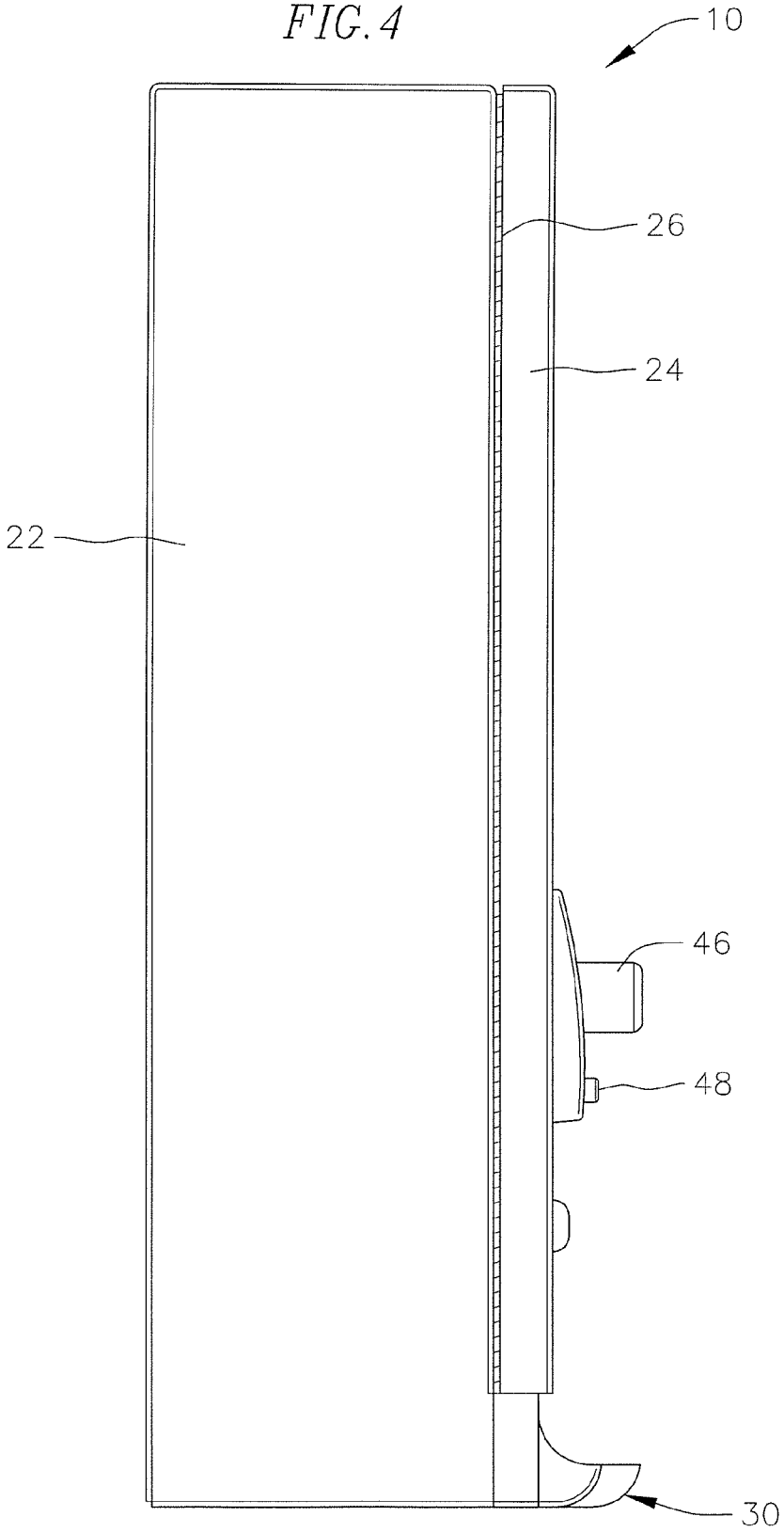
FIG. 4 is a side view of the vending apparatus of FIG. 1.
Figure 5:
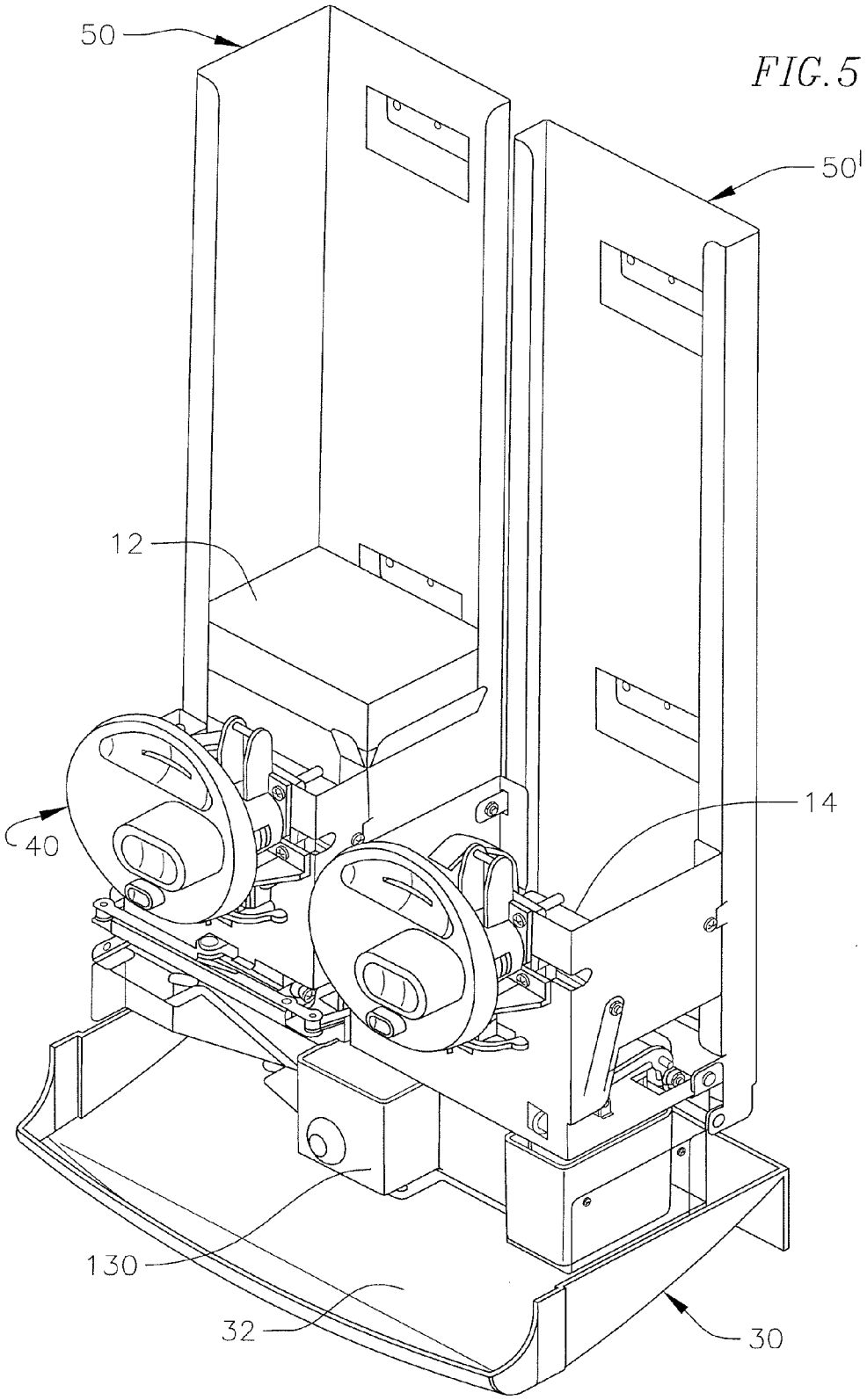
FIG. 5 is a perspective view of the vending apparatus of FIG. 1 shown with a cabinet assembly of the vending apparatus removed.
Figure 6:
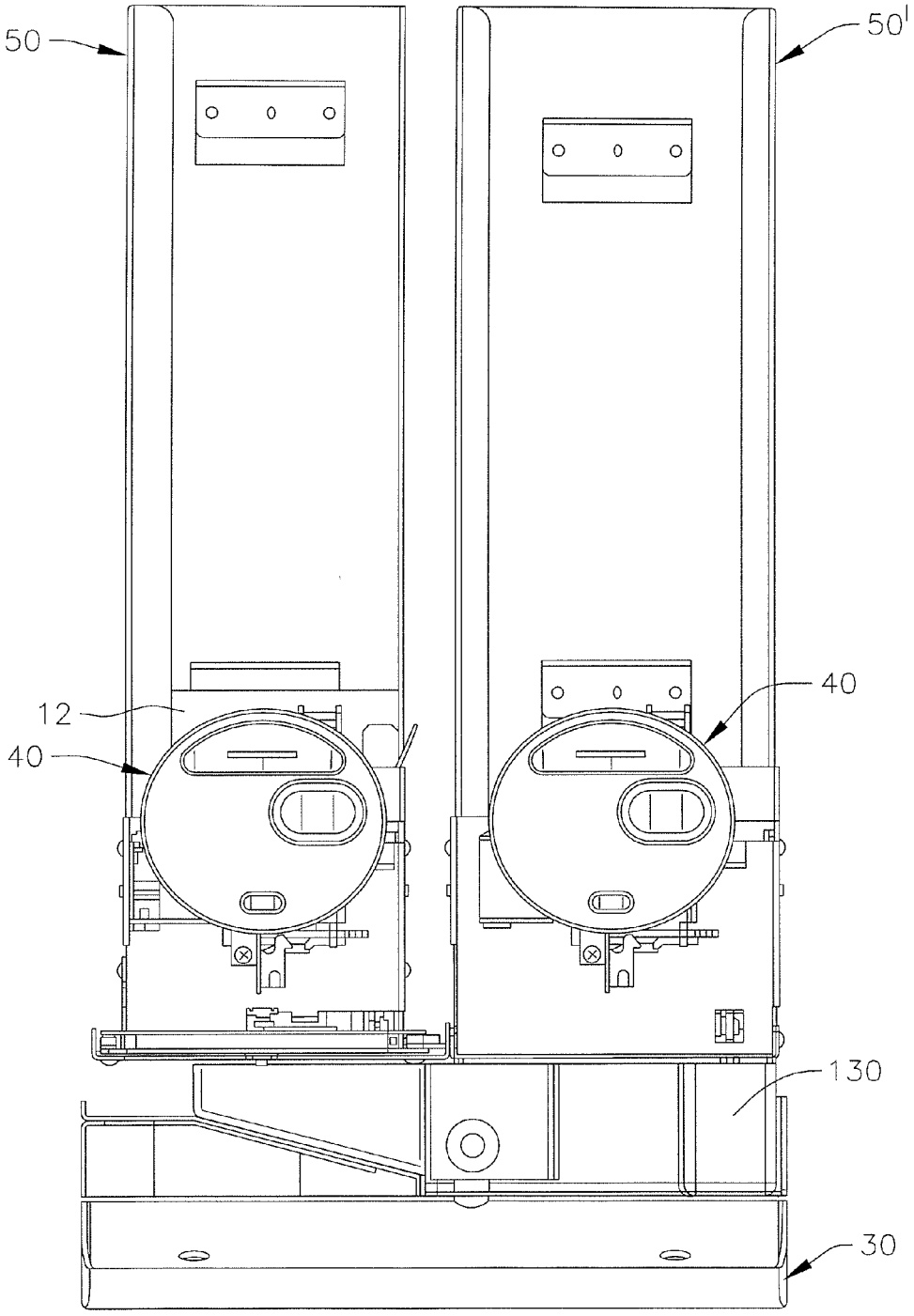
FIG. 6 is a front view of the vending apparatus of FIG. 1 shown with the cabinet assembly removed.

In the following detailed description, certain exemplary embodiments of the present invention are shown and described, by way of illustration. As those skilled in the art would recognize, the described exemplary embodiments may be modified in various ways without departing from the spirit and scope of the present invention. Accordingly, the drawings and description are to be regarded as illustrative in nature, rather than restrictive.

With reference to FIGS. 1-8, a vending apparatus 10 according to one exemplary embodiment of the present invention includes a cabinet assembly 20, a chute 30, a user interface 40, a first product vending portion 50 for vending a first product 12, and a second product vending portion 50' for vending a second product 14. Alternatively, the vending apparatus 10 may include only one of the first product vending portion 50 or the second product vending portion 50' or may include additional product vending portions. That is, although the vending apparatus shown and described herein includes two vending portions within a single cabinet assembly, each configured to vend a separate product, a vending apparatus according to other embodiments of the present invention may include any desired number of different products and vending portions for vending products within a single cabinet assembly.

The cabinet assembly 20 houses the first and second vending portion 50, 50' and the first and second products 12, 14, as well as other components of the vending apparatus 10. The cabinet assembly 20, in one exemplary embodiment, includes a cabinet 22 formed in the shape of a box from aluminum or stainless steel sheet, or any other suitable material. The cabinet assembly 20 in one embodiment includes a door 24 that is openable via one or more hinges 26 for providing access to the interior of the cabinet 22, such as for loading the first and second products 12, 14 or retrieving the coins. The cabinet assembly 20 may further include a lock 28 for locking the door 24 in a closed position to prevent access to the interior of the cabinet 22.

The chute 30 is configured to direct a purchased first product 12 or second product 14 from a product receptacle to the user. The chute 30, in one exemplary embodiment, is attached to a lower portion of the cabinet assembly 20 and includes a product tray 32 for holding the dispensed first product 12 or second product 14 to be taken by the purchaser. In one embodiment, the chute 30 and the tray 32 are formed as an integral unit.

The user interface 40 provides operability to the user of the vending apparatus 10. The user interface 40 according to one exemplary embodiment includes two bezels 42, one on either side of a front region of the cabinet assembly 20 (e.g., on the door 24). Each of the two bezels 42 is aligned with and corresponds to a respective one of the first and second product vending portions 50, 50' and includes a coin insertion opening 44 for receiving at least one coin therethrough, a product dispense push-button 46 for causing the first product 12 or the second product 14 to be dispensed after the required number of coins has been deposited into the coin insertion opening 44, and a coin return push-button 48 for returning coins to the user prior to dispensing of either of the first or second product 12, 14 sought to be purchased.

With reference to FIGS. 9-13, the first product vending portion 50, according to one exemplary embodiment, includes a first product receptacle 60, a flag member 70, a coin mechanism 100, and a dispense mechanism 200. As described further later herein, the second product vending portion 50' has a similar configuration and many of the same or substantially similar components as the first product vending portion 50, but may differ in some aspects due to different shapes and/or sizes between the first and second products 12, 14.

Figure 9:
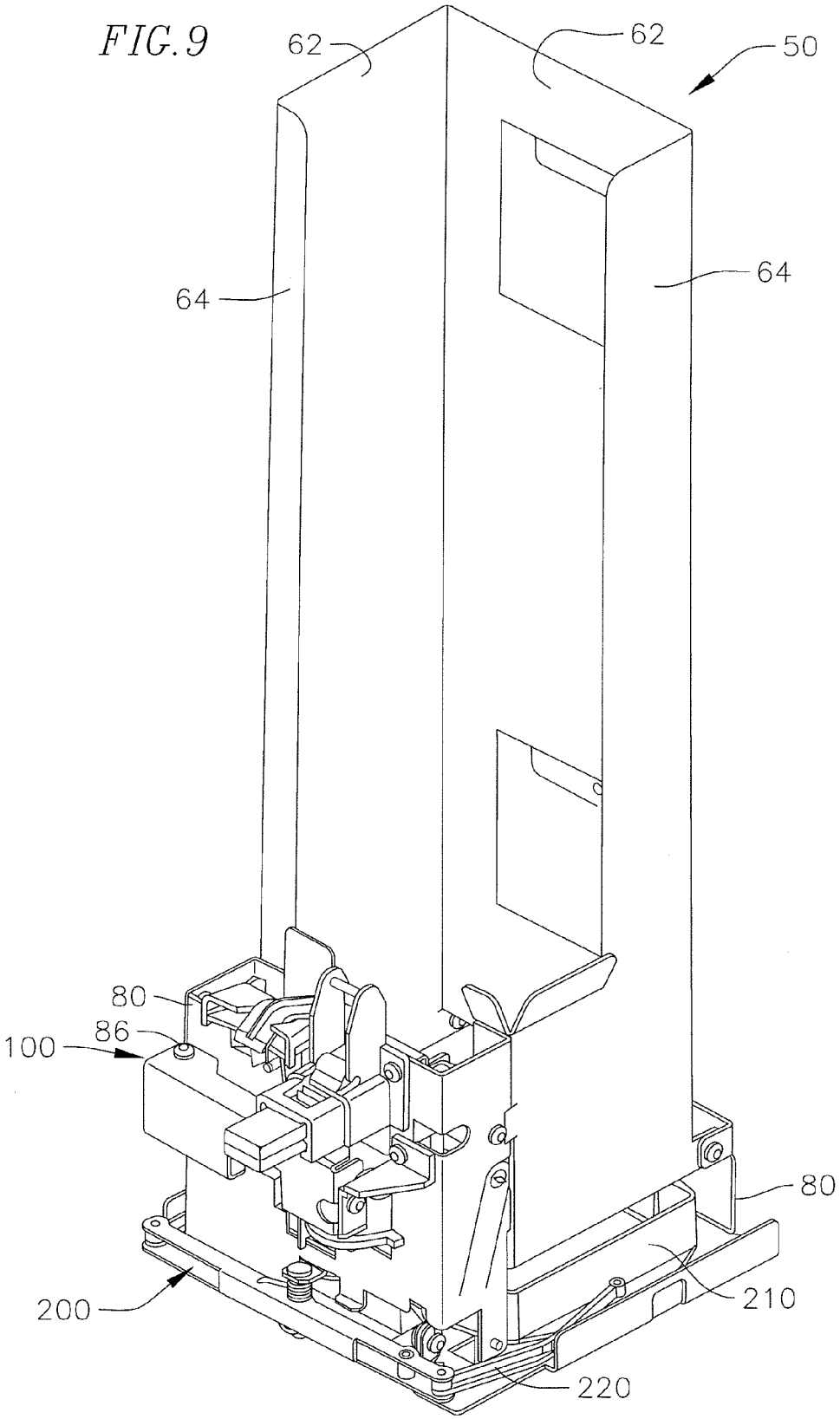
FIG. 9 is a perspective view of a first product vending portion of the vending apparatus of FIG. 1.
Figure 10:
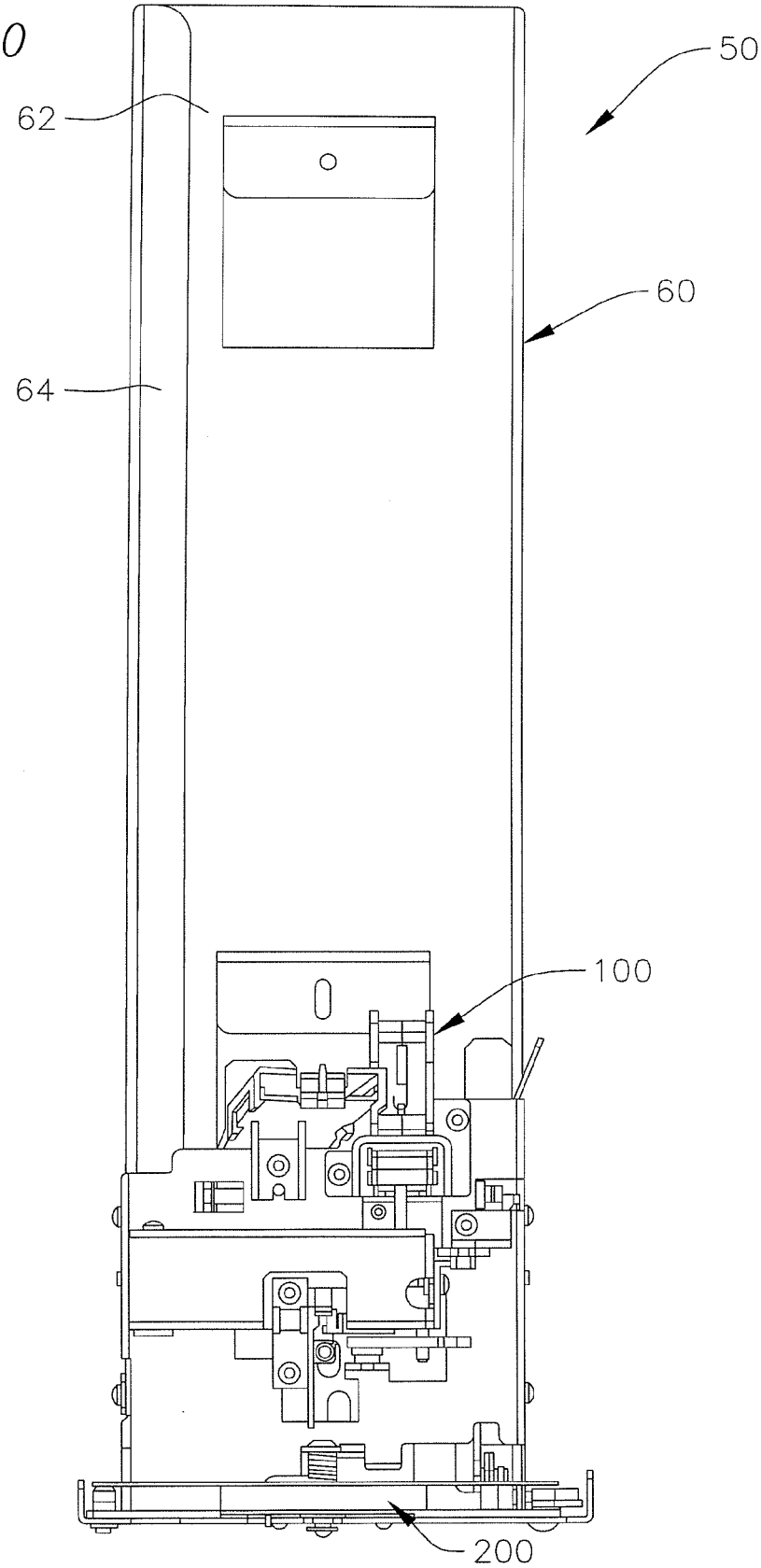
FIG. 10 is a front view of the first product vending portion of FIG. 9.
Figure 11:
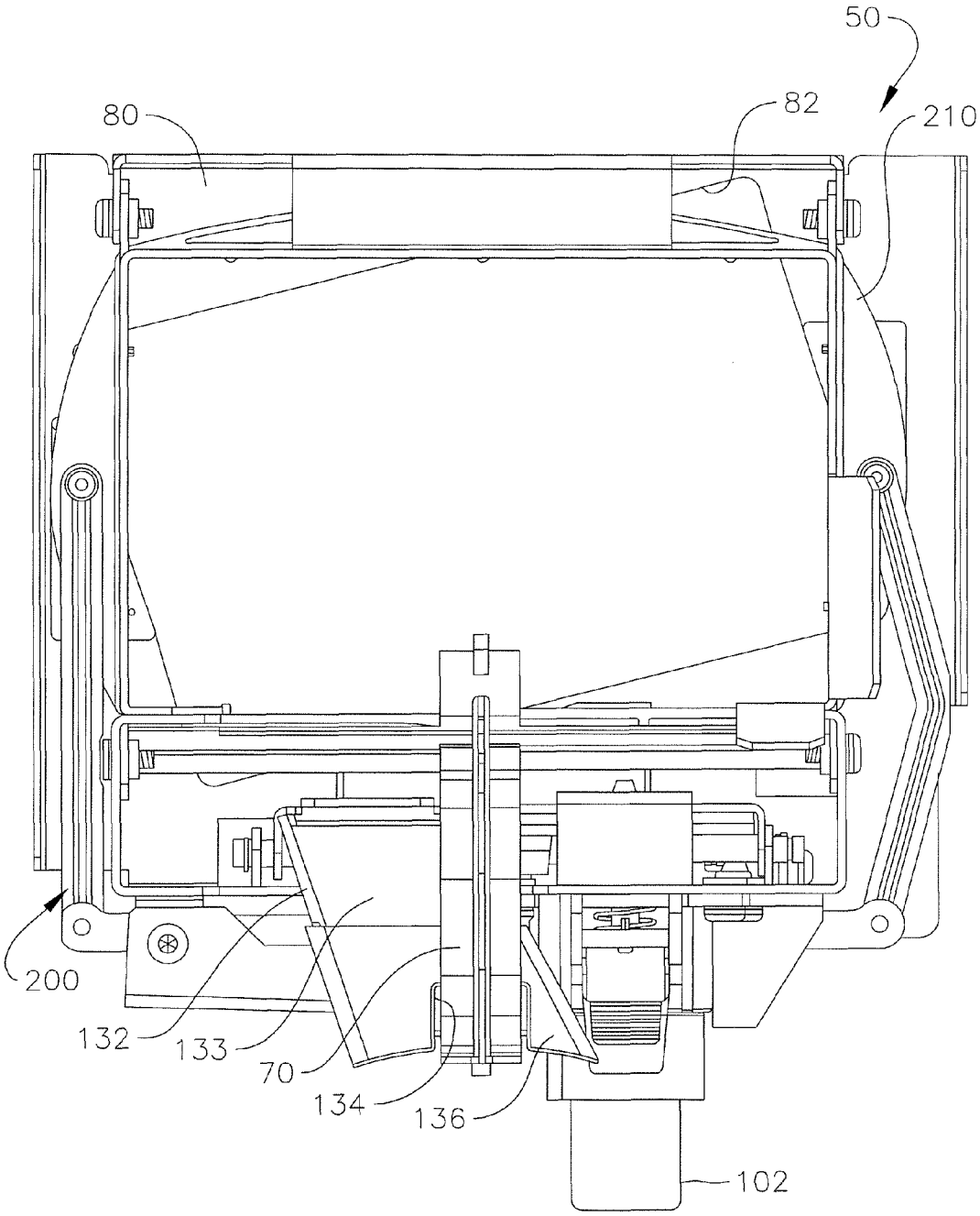
FIG. 11 is a top view of the first product vending portion of FIG. 9.
Figure 12:
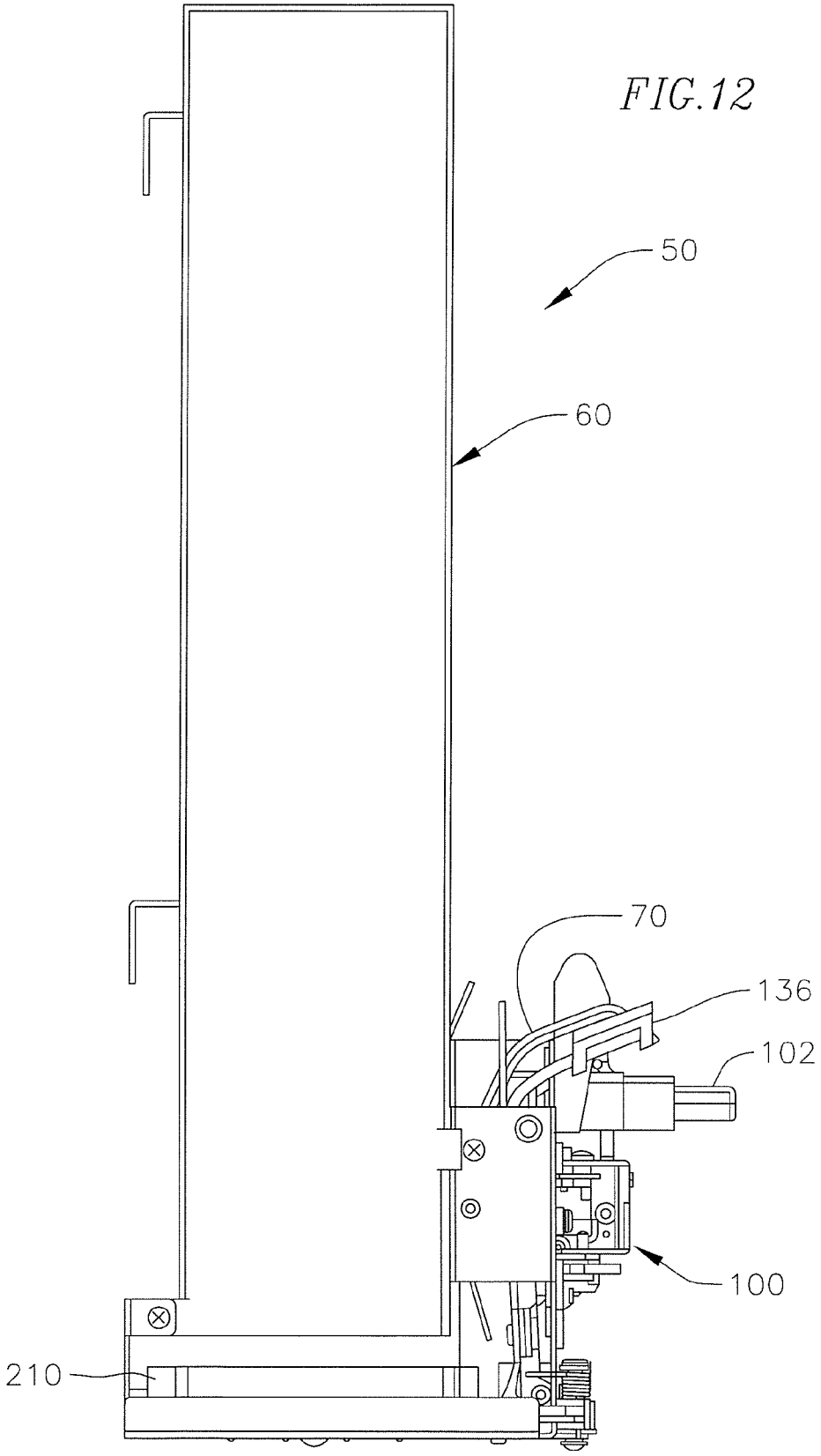
FIG. 12 is a side view of the first product vending portion of FIG. 9.

The first product receptacle 60 is configured to be loaded with the first products 12 and hold the first products 12 until purchased by and dispensed to the user. As such, the first product receptacle 60, in one embodiment, is configured to contain a number of the first products 12 stacked one above the other. For example, in the embodiment shown in the drawings, the first product 12 has a rectangular shape, such as that of a rectangular box, and the first product receptacle 60 is accordingly configured to have a cross-sectional shape of a rectangle or a portion thereof. In one embodiment, as shown in FIG. 9, for example, the first product receptacle 60 has vertical walls 62 forming at least two sides of a rectangle and flanges 64 protruding from opposite edges of the walls 62 to form at least portions of the other two sides of the rectangle for retaining the first products 12 in the first product receptacle 60 as the first product 12 is loaded into the first product receptacle 60 and also during dispensing of the first product 12 from the bottom of the first product receptacle 60. Alternatively, the first product receptacle 60 may have any other suitable configuration for holding the first product 12. The first product receptacle 60 may be formed of sheet metal, such as steel or aluminum, or any other suitable material.

In one exemplary embodiment, as shown in FIG. 9, a platform 80 is attached to the first product receptacle 60 at a lower portion thereof, such as via fasteners. Alternatively, the platform 80 may be integrally formed with the first product receptacle 60. The platform 80, in one embodiment, supports the coin mechanism 100 and the dispense mechanism 200 configured to dispense the first product 12 to a user. Further, the platform 80 has an opening 82 through a bottom surface thereof (see FIGS. 11 and 13) for discharging the first product 12 into the chute 30. The opening 82 has a shape substantially corresponding to a shape of the first product 12 (e.g., a rectangular shape) and has a size that is larger than a size of the first product 12, such that the first product 12 may drop through the opening 82 without obstruction when the dispense mechanism 200 is operated.

With reference to FIGS. 14-20, the coin mechanism 100 according to one exemplary embodiment of the present invention includes a first member 110 (or first plate) and a second member 120 (or second plate) which together define a coin slot 125 (see FIGS. 16 and 20) therebetween. The first and second members 110, 120, in one embodiment, are made of a metal, such as steel or aluminum, but alternatively may be made of any other suitable material, such as a hard plastic material. Much of the structure and operation of the coin mechanism 100 may be similar to embodiments of a coin mechanism disclosed in U.S. Pat. No. 7,469,779 to Horian, the entire content of which is incorporated by reference herein.

The coin mechanism 100, in one exemplary embodiment, is configured to accept only one denomination of coin, whereby coins of other denominations will fall through the coin slot 125 and into a coin return area. In one embodiment, a post 106 (see FIGS. 15 and 20) protrudes, in a first position, into the coin slot 125 between the first and second members 110, 120 for holding an inserted coin of a selected denomination until the product dispense push-button 46 is depressed for actuation. The post 106 is moveable between the first position and a second position in which the post 106 does not protrude into the coin slot 125 between the first and second members 110, 120 and in which inserted coins will fall through the slot and into a coin return area. The post 106 is engageable with the coin return push-button 48, such as via a lever 107 (see FIG. 15), and is moveable from the first position to the second position by depressing the coin return push-button 48. More specifically, in one embodiment, the lever 107 is pivotably coupled to the platform 80, and the post 106 is attached to or integrally formed with the lever 107. Alternatively, the post 106 may be coupled to or integrally formed with the coin return push-button 48. In another embodiment, the coin mechanism 100 may be configured to accept different denominations of coins, such as by adjusting the size and/or location of the post 106 in the coin slot 125 and/or adjusting the geometry (e.g., the width) of the coin slot 125. Further, in various embodiments, the coin mechanism 100 may be configured to be actuated upon insertion of a single coin or any desired number of coins based on a location (e.g., a location relative to the location of the post 106) of a push member 108 (described further below) of the coin mechanism 100 for pushing a first coin or any coin of a plurality of inserted coins against the second member 120 for displacing the first and second members 110, 120 to an actuated position.

The first and second members 110, 120, in one embodiment, are fixed together (e.g., via fasteners or any other suitable device). Alternatively, the first and second members 110, 120 may be integrally formed as a single unit. Further, one of the first and second members 110, 120 (e.g., the first member 110, or the "channel member") has a channel 112 (see FIG. 20) formed in a surface thereof that faces the other of the first and second members 110, 120 (e.g., the second member 120, or the "support member") for providing a pathway (i.e. the coin slot 125) for at least one deposited coin to travel between the first and second members 110, 120. The first and second members 110, 120 are moveable together between a first position (e.g., a non-displaced, or unactuated, position) and a second position (e.g., a displaced, or actuated, position). More specifically, in one embodiment, the first and second members 110, 120 are rotatably coupled to the platform 80 via a pivot member 128 and are rotatable between the first and second positions about a longitudinal axis of the pivot member 128. The configuration of the first and second members 110, 120 and their arrangement relative to one another is the same or substantially similar to that described in U.S. Pat. No. 7,469,779 to Horian, the entire content of which is incorporated by reference herein. The position of the first and second members 110, 120 is determinative of whether the at least one deposited coin may fall into a coin bank 130 (see FIG. 5) (e.g., when the product dispense push-button 46 is depressed) or into a coin return area (e.g., when the coin return push-button 48 is depressed). For example, in one exemplary embodiment, when the product dispense push-button 46 is not depressed, the first and second members 110, 120 are in the first, or unactuated, position in which the coin slot 125 is aligned with an opening leading to the coin return area and remain in the first position when the coin return push-button 48 is depressed, thereby sending the at least one coin into the coin return area. Further, when the product dispense push-button 46 is depressed, an actuator 102 is actuated and displaces the first and second members 110, 120 to the second, or actuated, position in which the coin slot 125 is aligned with an opening leading to the coin bank 130. The actuator 102, in one embodiment, is supported on an actuator housing 104 attached to the platform 80.

The first product vending portion 50, in one exemplary embodiment, further includes a coin guide 132 having a channel 133 (see FIGS. 15 and 16) for guiding a coin deposited into the coin insertion opening 44 toward the coin slot 125 formed between the first and second members 110, 120. The channel 133, in one embodiment, has a contoured shape configured to deter fraudulent attempts to obtain the first product 12 or the deposited coins. For example, the channel 133 may have one or more portions curved in a convex or concave shape, such that a long object may not be insertable into the coin insertion opening 44. The coin guide 132 may be made of a hard plastic material or any other suitable material. Further, the coin guide 132 may include a notch 134 (see FIG. 15) or other feature for engaging a flag member 70, described in further detail below. Further, in one exemplary embodiment, the first product vending portion 50 includes a coin guide cover 136 attached to or integrally formed with the coin guide 132 over the channel 133. The coin guide cover 136 is coupled to the coin guide 132 over the channel 133, such as at an upper portion of the coin guide 132 near the coin insertion opening 44, for maintaining a deposited coin in the channel 133 and preventing the coin from falling over the above-described contoured portion of the channel 133 due to its momentum.

With further reference to FIGS. 14-20, the coin mechanism 100, according to one exemplary embodiment, further includes a delay mechanism 150 configured to delay a return of the first and second members 110, 120 to the first position after actuation to the second position and thereby reduce a likelihood of the deposited coins being sandwiched between the first and second members 110, 120 and jamming due to a force exerted by a return biasing member 170 before falling into the coin bank 130. For example, the return biasing member 170 may be a spring or other suitable biasing mechanism that provides a biasing force for returning a discharge chamber of the dispense mechanism 200 from a discharge position to a loading position, described in further detail below with respect to the dispense mechanism 200. The delay mechanism 150 is configured to slow the return of the first and second plates 110, 120 toward the first position in order to allow the at least one coin to drop into the coin bank 130.

According to one exemplary embodiment, the delay mechanism 150 includes a cam 152, a damper 154, an actuation lever 156, and a ratchet mechanism 162. The actuation lever 156 is moveable between a first position corresponding to a non-actuated state and a second position corresponding to an actuated state when the actuator 102 is actuated by depressing the product dispense push-button 46. In one embodiment, the actuation lever 156 is supported by the platform 80 and is rotatable between the first position and the second position about a pivot 86 (see FIGS. 9 and 14). In one embodiment, the actuation lever 156 includes a first protrusion 157 (e.g., a pin) (see FIGS. 15 and 17) which is displaceable by the actuator 102 when the actuator 102 is depressed for moving the actuation lever 156 to the second, or actuated, position. The first protrusion 157 is also displaceable by the actuator 102 when the actuator 102 is released and pushed back toward the unactuated position by the return biasing member 170, such that the actuation lever 156 is also moved back toward the first, or unactuated, position. Therefore, the actuation lever 156, together with the actuator 102, is biased via the return biasing member 170 toward a first position corresponding to the actuator 102 being in a non-actuated state and the first and second plates 110, 120 being in the first, or non-displaced, position.

The actuation lever 156, in one embodiment, includes the push member 108 (see FIGS. 16 and 18) coupled to the actuation lever 156 or integrally formed therewith for pushing an inserted coin against the second member 120 and thereby displacing the first and second members 110, 120 to the actuated position. In one embodiment, the actuation lever 156 includes a second protrusion 158 (e.g., a pin) (see FIGS. 15 and 17) for engaging the cam 152 when the actuation lever 156 is moved back toward the first, or unactuated, position. Further, in one exemplary embodiment, the actuation lever 156 includes a damper engaging portion 160 (see FIG. 18) for engaging the damper 154, which is attached to the platform 80, and thereby slowing a return of the actuation lever 156 toward the non-actuated position and delaying release of the cam 152 to allow the first and second members 110, 120 to move back toward the first position, thereby ensuring that the coin drops into the coin bank 130. Alternatively, the damper 154 may be attached to the actuation lever 156, and a damper engaging portion similar to the damper engaging portion 160 may be attached to the platform 80. The damper 154, in one exemplary embodiment, is a Richco damper, part number RFRT-G2-300-G1. Alternatively, any other suitable damper may be used as the damper 154, such as any other hydraulic rotation damper.

The cam 152 is configured to engage prior to or at the same time in which the first product 12 is dispensed to prevent retrieval of the at least one coin by the purchaser. Further, the cam 152 prevents the first and second members 110, 120, after actuation, to return toward the first position until the cam 152 is released. The cam 152 holds the first and second members 110, 120 in the actuated position to assure release of the coin. That is, the cam 152 acts as a physical stop against the first member 110 to retain the actuation lever 156 from swinging back toward the first position and is biased toward the actuated position by a biasing member 153 (e.g., a spring). Because the cam 152 is biased toward the actuated position by the biasing member 153, the cam 152 also functions to allow the coin to be held wedged in the coin slot 125 by the push member 108 until the actuation lever 156 begins to return toward the first position, at which time the coin is allowed to drop into the coin bank 130. The cam 152, in one exemplary embodiment, is rotatably coupled to the platform 80 and has a horseshoe shape wherein an outer portion is contactable against the first plate 110 for holding the first and second member 110, 120 in the second, or actuated, position for allowing the coin to drop, and an inner portion is engageable with the second protrusion 158 for releasing the cam 152 when the actuation lever 156 is moved back toward the first, or unactuated, position. Further, the cam 152 may be made from a hard plastic material, or any other suitable material.

The ratchet mechanism 162 includes a rack of teeth 163 on the actuator 102, a pawl 164 for engaging the rack of teeth 163, and a biasing member 165 (e.g., a spring) connected to the pawl 164 for providing a biasing force on the pawl 164 against the rack of teeth 163. The ratchet mechanism 162, in one embodiment, is supported on the actuator housing 104. As the actuator 102 is depressed, the rack of teeth 163 moves past the pawl 164, one tooth at a time, until the rack of teeth 163 completely clears the pawl 164, at which point the actuator 102 may be fully engaged for dispensing the first product 12. When the actuator 102 is released, the biasing member 170 pushes the actuator 102 back toward the first, or unactuated, position, the coin drops into the coin bank 130, and the actuator 102 pushes against the first protrusion 157 to move the actuation lever 156 back toward the first position. Once the actuation lever 156 has moved back toward the first position by a certain amount, the second protrusion 158 contacts against an inner surface of the cam 152, such that as the actuation lever 156 continues to move further toward the first position, the second protrusion 158 pushes on and releases the cam 152, thereby allowing the first and second members 110, 120 to return toward the first, or unactuated position. As such, the cam 152 may only be released by the second protrusion 158 of the actuation lever 156 once the pawl 164 has cleared the rack of teeth 163. The ratchet mechanism 162 thereby prevents an inserted coin from dropping until the pawl 164 has cleared the rack of teeth 163 by fully depressing the actuator 102.

With further reference to FIGS. 14-20, the dispense mechanism 200 according to one exemplary embodiment includes a rotatable discharge chamber 210. The discharge chamber 210 is configured to hold a first product 12 below one or more other first products 12 that are held (e.g., stacked) in the first product receptacle 60. When a user inserts the required number of coins into the coin insertion opening 44 and actuates the actuator 102 of the coin mechanism 100 by depressing the product dispense push-button 46, the dispense mechanism 200 dispenses the first product 12 from the discharge chamber 210 by rotating the discharge chamber 210 from a first position to a second position, and subsequently another first product 12 drops from the bottom of the stack of first products 12 held in the first product receptacle 60 upon rotation of the discharge chamber 210 back to the first position.

Figure 13:
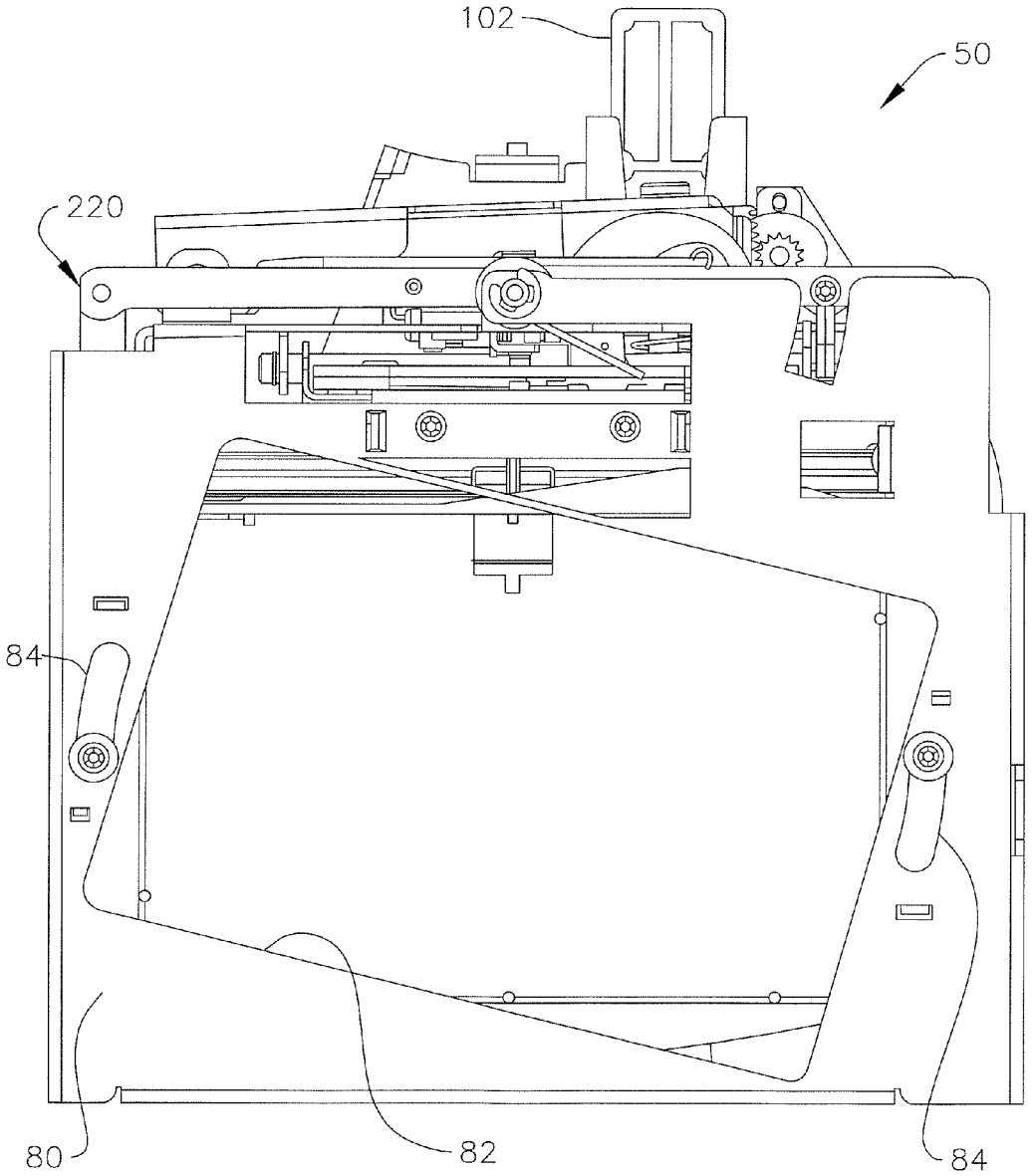
FIG. 13 is a bottom view of the first product vending portion of FIG. 9.

The dispense mechanism 200 in one exemplary embodiment further includes a linkage 220 connecting the discharge chamber 210 to the first and second members 110, 120 of the coin mechanism 100. The linkage 220 is connected between the discharge chamber 210 and the first and second members 110, 120 such that when the actuator 102 displaces the first and second members 110, 120, the linkage 220 causes the discharge chamber 210 to rotate relative to the product receptacle 60 and also relative to the platform 80 and the opening 82 therethrough. In one exemplary embodiment, the linkage 220 includes a first linkage member 222 and a pair of second linkage members 224 connected to the first linkage member 222 at opposite ends thereof. The first linkage member 222 is connected to the second member 120 via a connecting member 225 and is rotatable about a pivot 226 spaced apart from the connecting member 225 when the first and second member 110, 120 are displaced. Further, when the first linkage member 222 is rotated about the pivot 226, the first linkage member 222 moves the second linkage members 224, which, in turn, move the discharge chamber 210. In one embodiment, as shown in FIG. 13, the platform 80 has a pair of slots 84 for allowing ends of the respective second linkage members 224 to move and rotate the discharge chamber 210 relative to the platform 80. In one embodiment, the dispense mechanism 200 includes a biasing mechanism 228 (e.g., a spring) configured to bias the discharge chamber 210 toward the first position. Further, because the first linkage member 222 is connected to the second member 120 via the connecting member 225, the biasing mechanism 228 may also bias the first and second members 110, 120 toward the first, or unactuated, position.

Figure 21A:
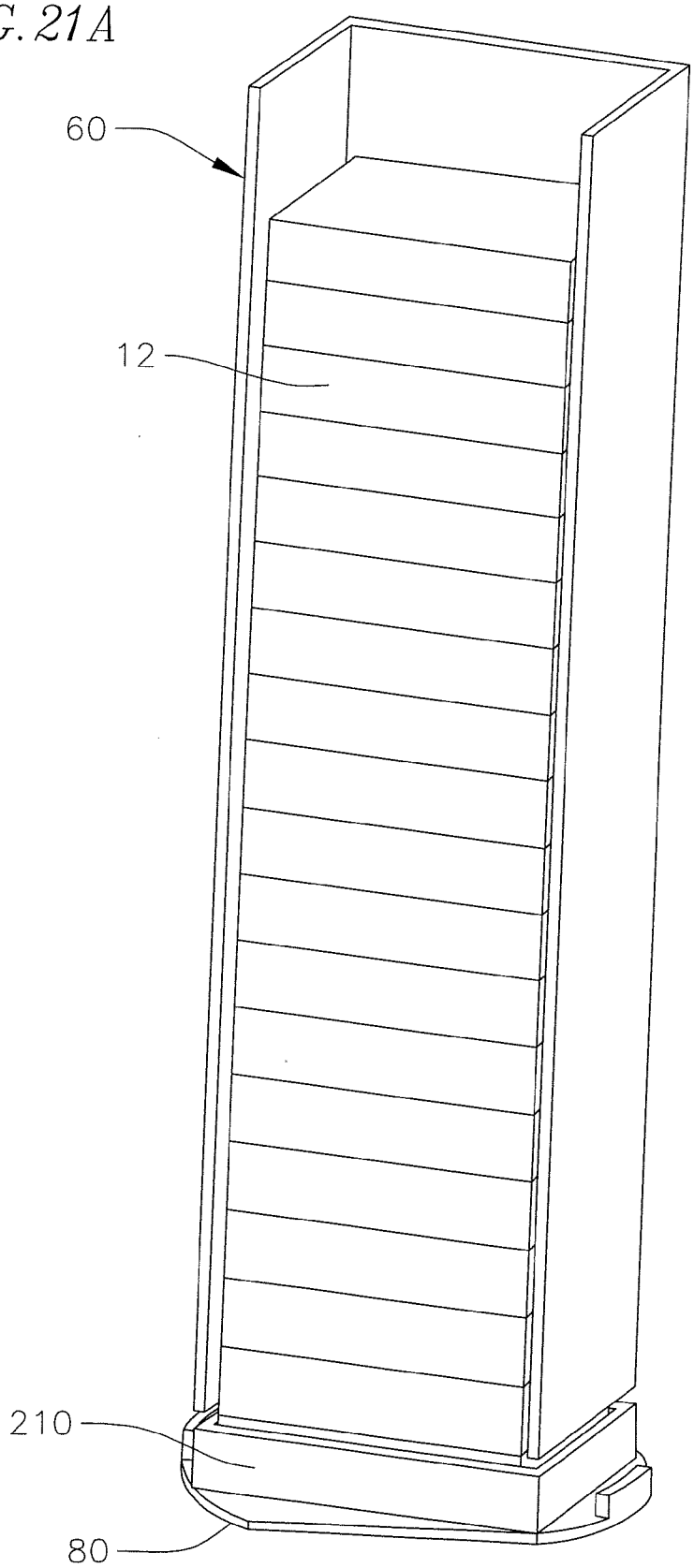
FIGS. 21A and 21B are a schematic front perspective view and a schematic bottom perspective view, respectively, showing a discharge chamber of the dispense mechanism of FIG. 14 in a non-dispensing position.
Figure 21B:
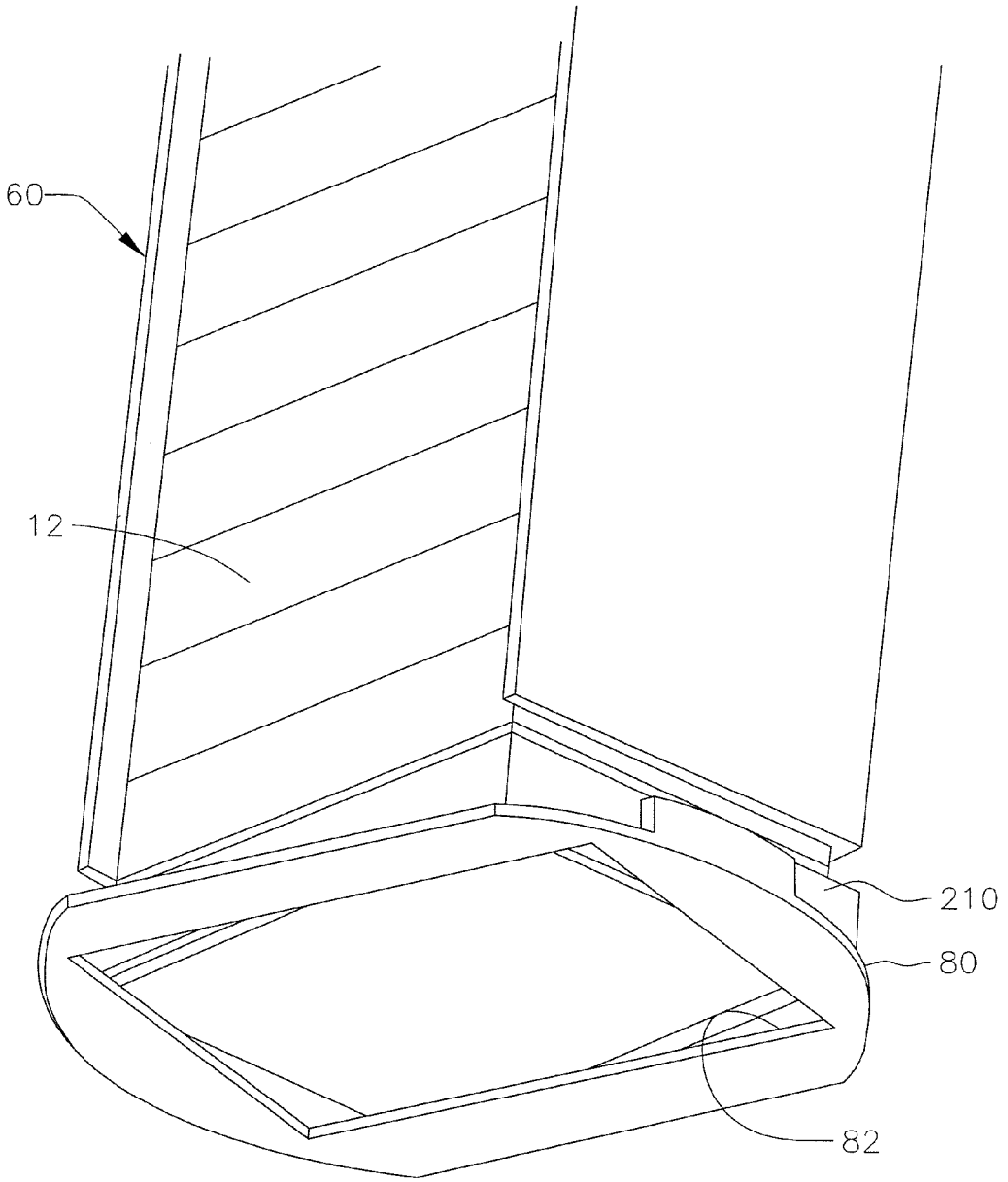

With reference to FIGS. 21A-21D, operation of the dispense mechanism 200 is shown. In FIGS. 21A and 21B, the dispense mechanism 200 is shown having the discharge chamber 210 in the first position (i.e. a non-dispensing position). In the first position, side walls of the rectangular shaped discharge chamber 210 are substantially aligned with the walls 62 and the flanges 64 of the first product receptacle 60. As described above, the opening 82 of the platform 80, in one embodiment, also has a shape substantially corresponding to a shape of the first product 12 (e.g., a rectangular shape), but the edges of the opening 82 are at an angle (e.g., about 15 degrees, or any other suitable angle) relative to the walls 62 and the flanges 64 of the first product receptacle 60 such that when the discharge chamber 210 is in the first position, the first product 12 in the discharge chamber 210 does not drop through the opening 82 of the platform 80, but instead rests on the platform 80 at corner regions of the first product 12, as shown in FIG. 21B.

Figure 21C:
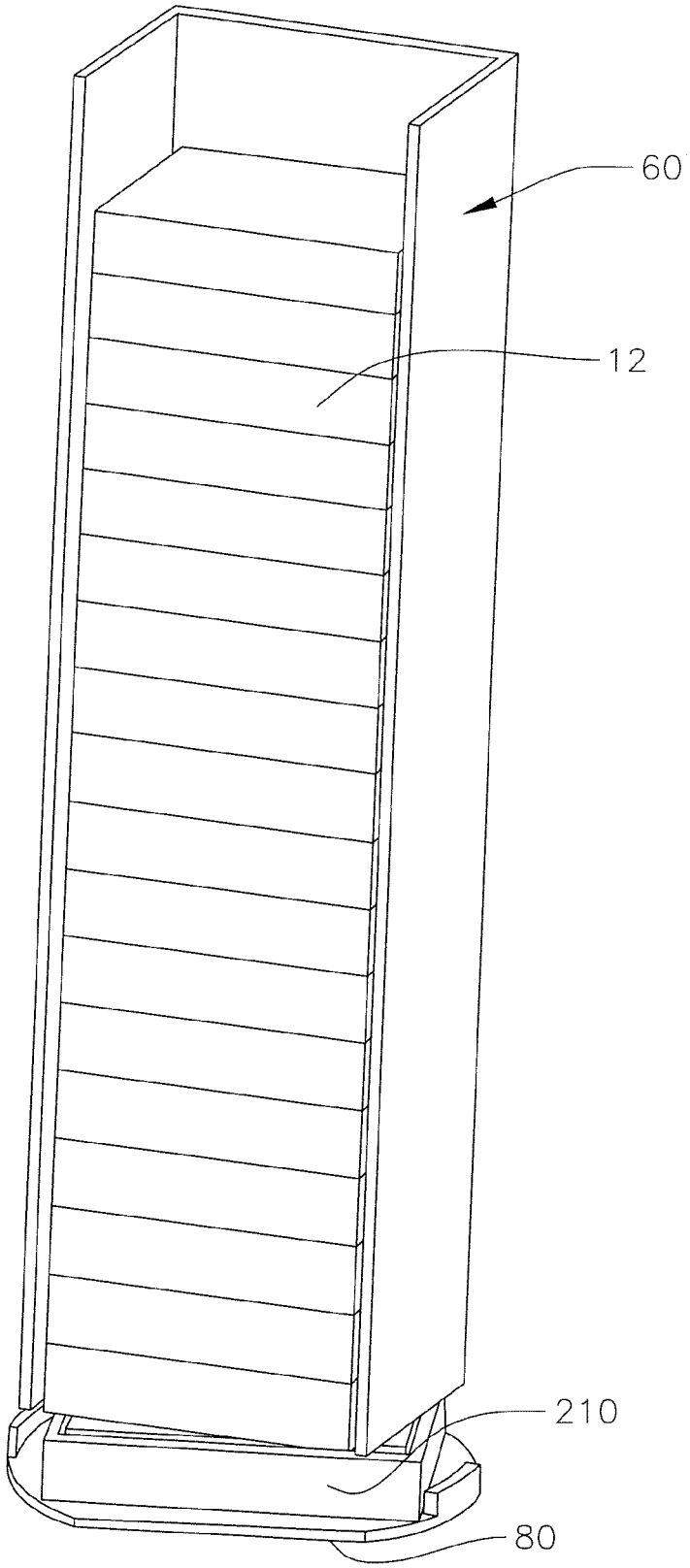
FIGS. 21C and 21D are a schematic front perspective view and a schematic bottom perspective view, respectively, showing the discharge chamber of the dispense mechanism of FIG. 14 in a dispensing position.
Figure 21D:
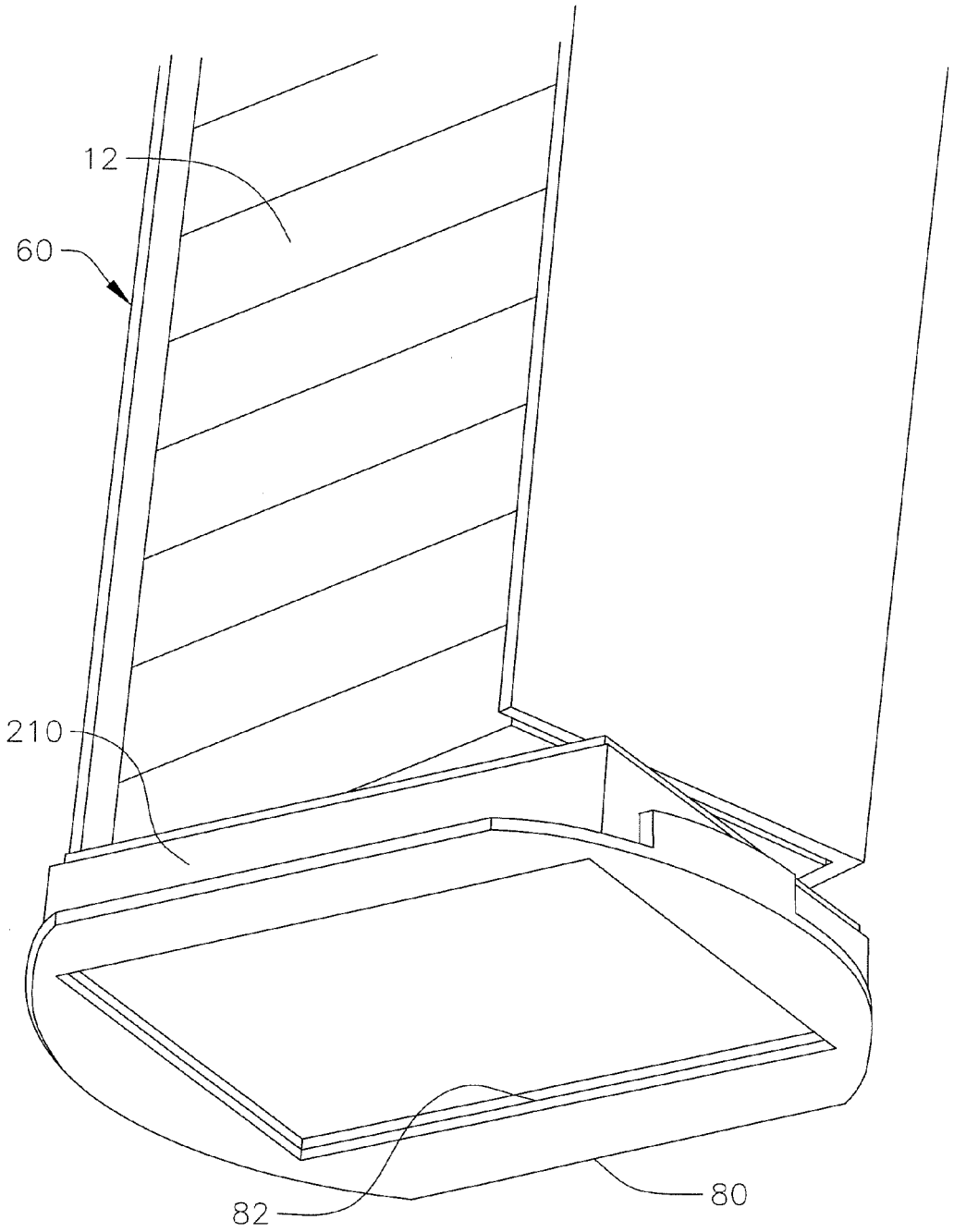

In FIGS. 21C and 21D, the dispense mechanism 200 is shown having the discharge chamber 210 in the second position (i.e. a dispensing position). In the second position, the discharge chamber 210 is rotated relative to the first product receptacle 60 and the platform 80 via the linkage 220 (not shown) such that the side walls of the discharge chamber 210 are substantially aligned with the edges of the opening 82 of the platform 80. Because the first product 12 has substantially the same shape as the shape formed by the walls of the discharge chamber 210, when the discharge chamber 210 is in the second position, the first product 12 is aligned to drop through the opening 82 of the platform 80 and onto the chute 30. The linkage 220, in one exemplary embodiment, is configured to rotate the discharge chamber 210 rapidly from the first position to the second position so that one corner of the first product 12 does not fall through the opening 82 before remaining portions and cause the first product 12 to become cocked. Rather, by rotating the discharge chamber 210 rapidly, the first product 12 remains substantially parallel to the platform 80 as it drops through the opening 82, thereby reducing a likelihood of jamming. In one exemplary embodiment, the linkage 220 is configured to rotate the discharge chamber 210 rapidly from the second position back to the first position so that another first product 12 stacked immediately above the dispensed first product 12 falls into the discharge chamber 210 quickly and does not become cocked or jammed. For example, the linkage 220 may be configured to rotate the discharge chamber 210 more rapidly from the second position back to the first position than from the first position to the second position.

Further, in one exemplary embodiment, the side walls of the discharge chamber 210 have a height such that top edges of the side walls are lower than a top surface of the first product 12 in the discharge chamber 210 (see, e.g., FIG. 21A). As such, when the discharge chamber 210 is rotated to the second position, the side walls of the discharge chamber 210 do not contact another first product 12 immediately above the first product 12 in the discharge chamber 210. Additionally, because the side walls of the discharge chamber 210 are not aligned with the sides of the first product 12 immediately above the first product 12 in the discharge chamber 210 when the discharge chamber 210 is in the second position, the first product 12 immediately above the first product 12 in the discharge chamber 210 cannot drop into or through the discharge chamber 210 when the first product 12 in the discharge chamber 210 drops through the opening 82 of the platform 80. That is, the first product 12 immediately above the first product 12 being dispensed when the discharge chamber 210 is in the second position cannot drop into the discharge chamber 210 until the discharge chamber 210 has returned to the first position. As such, embodiments of the dispense mechanism 200 according to the present invention are configured to reduce a likelihood of the first product 12 jamming in the dispense mechanism 200 and also of dispensing more first products 12 than purchased.

Subsequent to the first product 12 dropping through the opening 82 and upon release of the product dispense push-button 46 by the user, the return biasing member 170 causes the first and second members 110, 120 to be displaced back toward the first position, thereby causing the linkage 220 to rotate the discharge chamber 210 back to the first position, at which time another first product 12 at the bottom of the stack of first products 12 in the first product receptacle 60 drops into the discharge chamber 210 and comes to rest on the platform 80.

Embodiments of the dispense mechanism 200 described herein have a configuration that allows a depth dimension of the cabinet assembly 20 to be reduced. That is, because the first product 12 is rotated by a small predetermined angle, such as about 15 degrees, the required depth of the cabinet assembly 20, which is dependent on a corner-to-corner distance of the first product 12 while in the rotated, or dispensing, position, is reduced by exemplary embodiments of the dispense mechanism 200 described herein.

Figure 14:
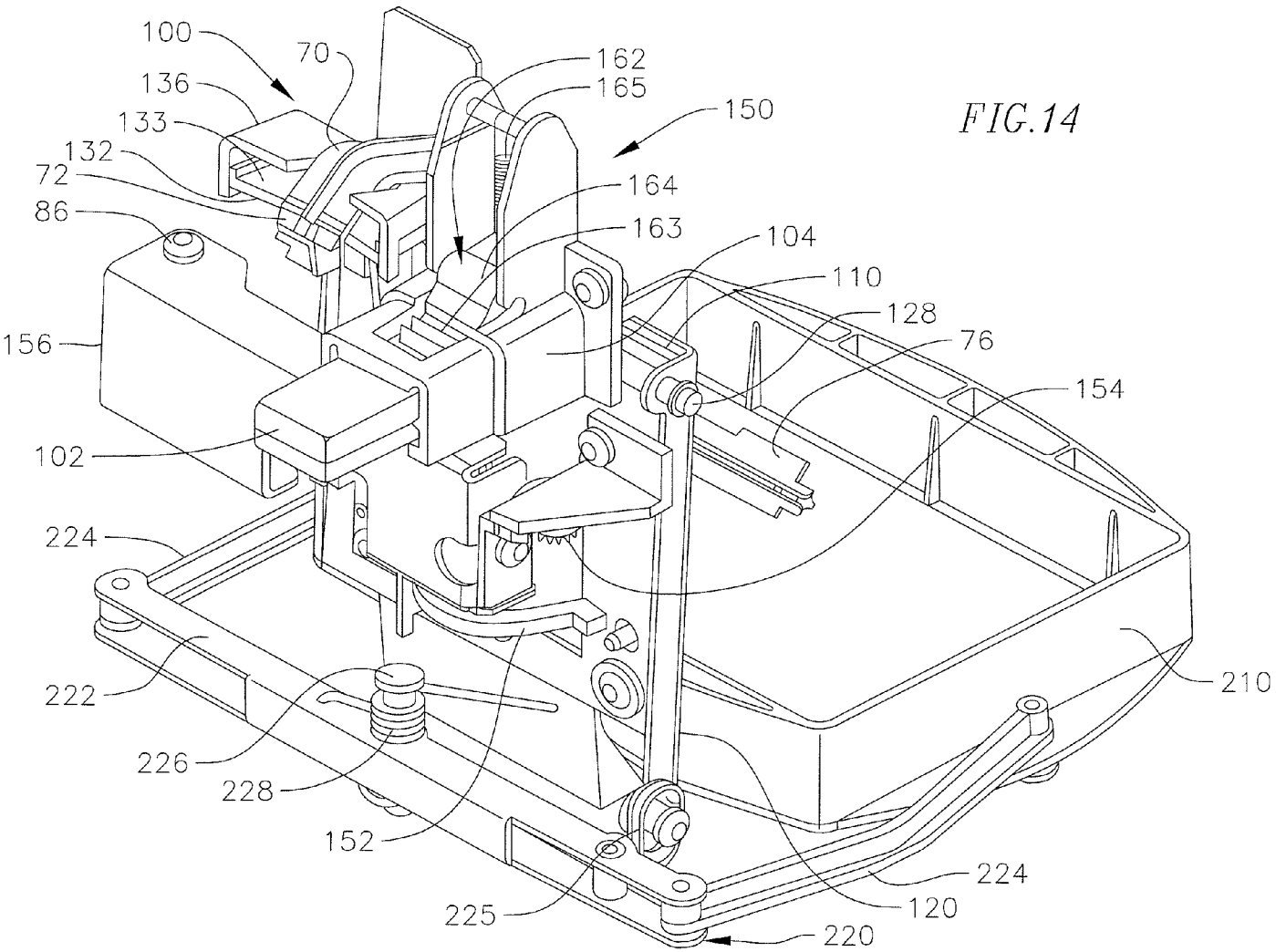
FIG. 14 is a perspective view of a coin mechanism and a dispense mechanism of the vending apparatus of FIG. 1.
Figure 15:
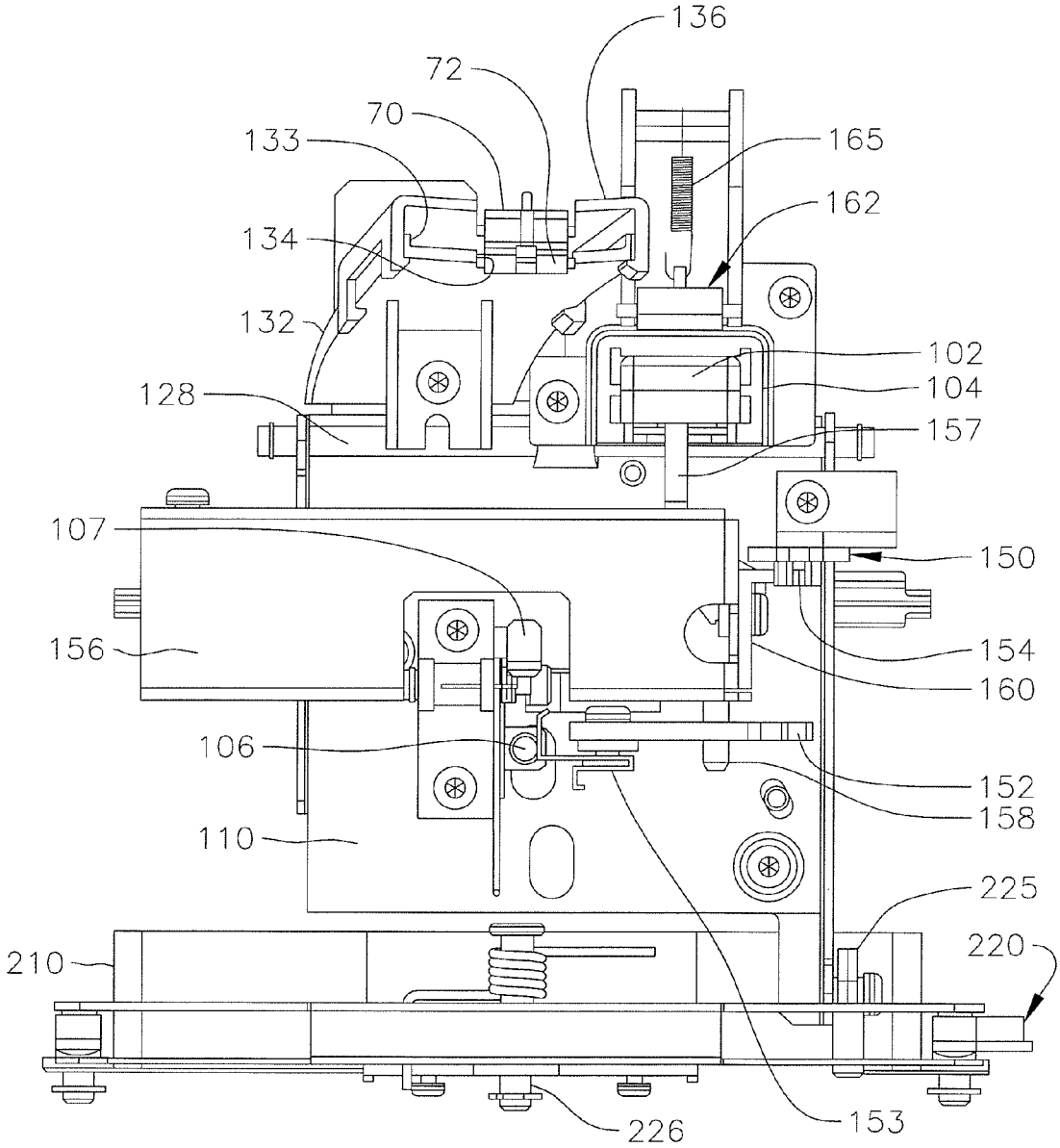
FIG. 15 is a front view of the coin mechanism and dispense mechanism of FIG. 14.
Figure 16:
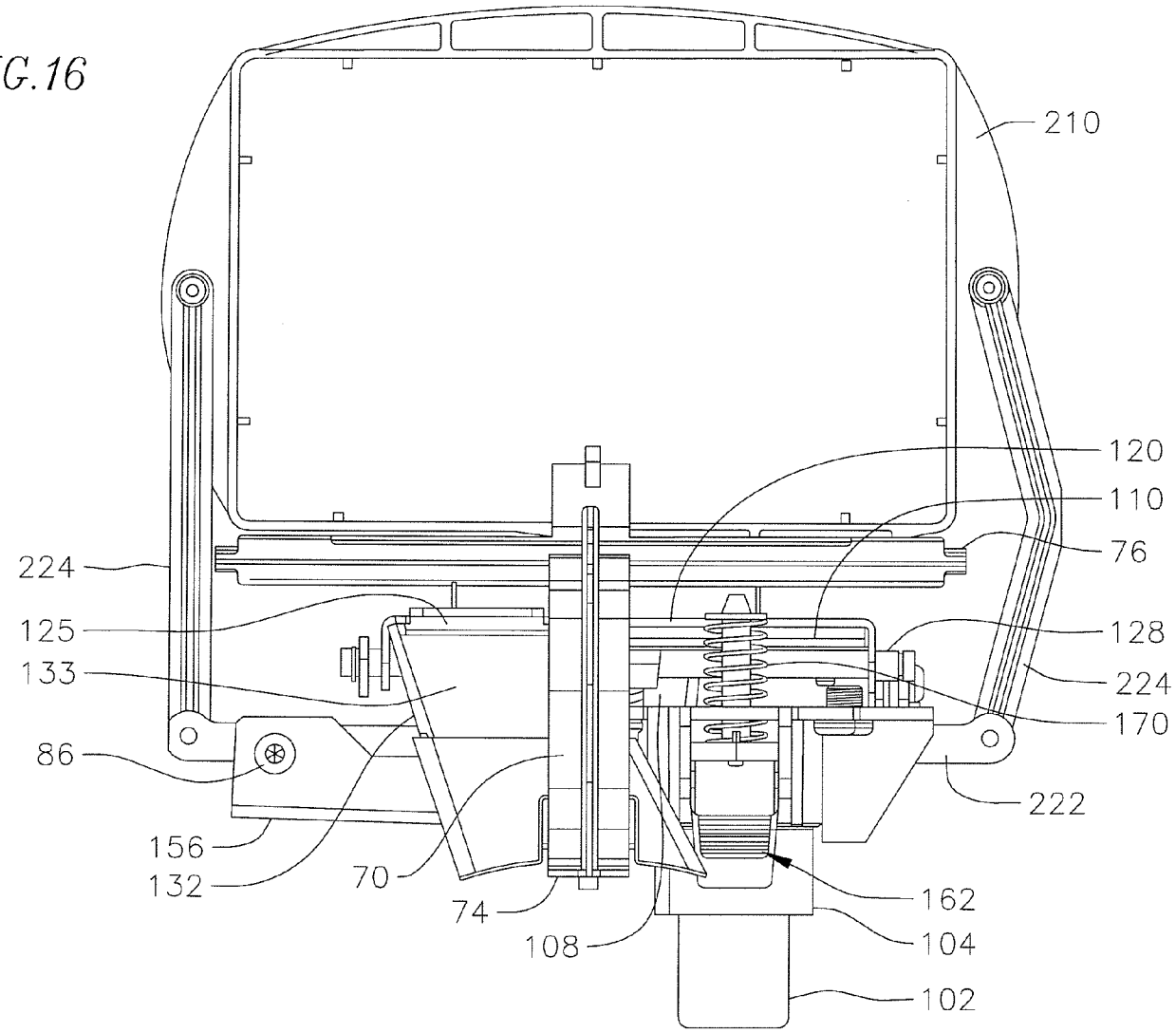
FIG. 16 is a top view of the coin mechanism and dispense mechanism of FIG. 14.
Figure 17:
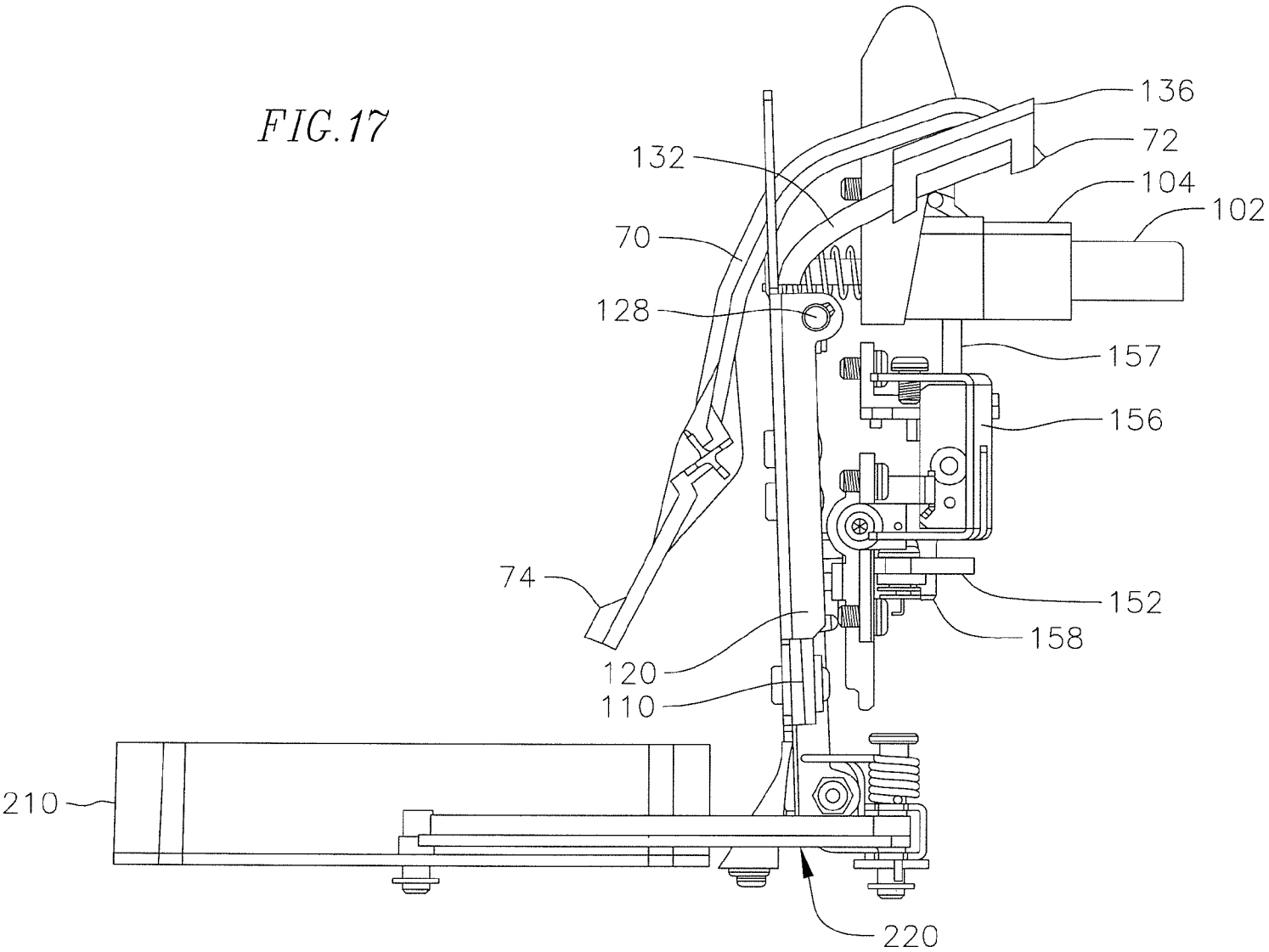
FIG. 17 is a side view of the coin mechanism and dispense mechanism of FIG. 14.
Figure 18:
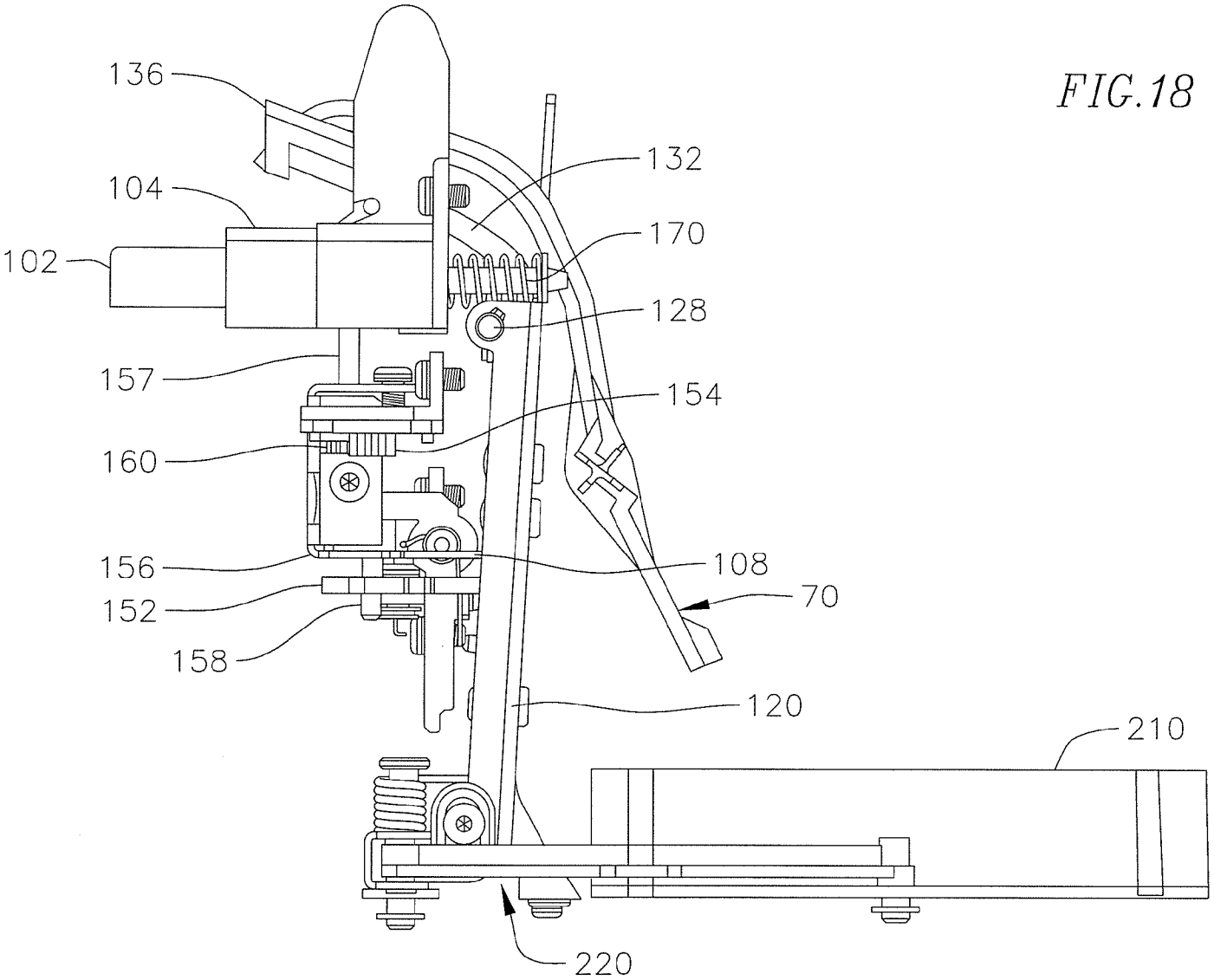
FIG. 18 is an opposite side view of the coin mechanism and dispense mechanism of FIG. 14.
Figure 19:
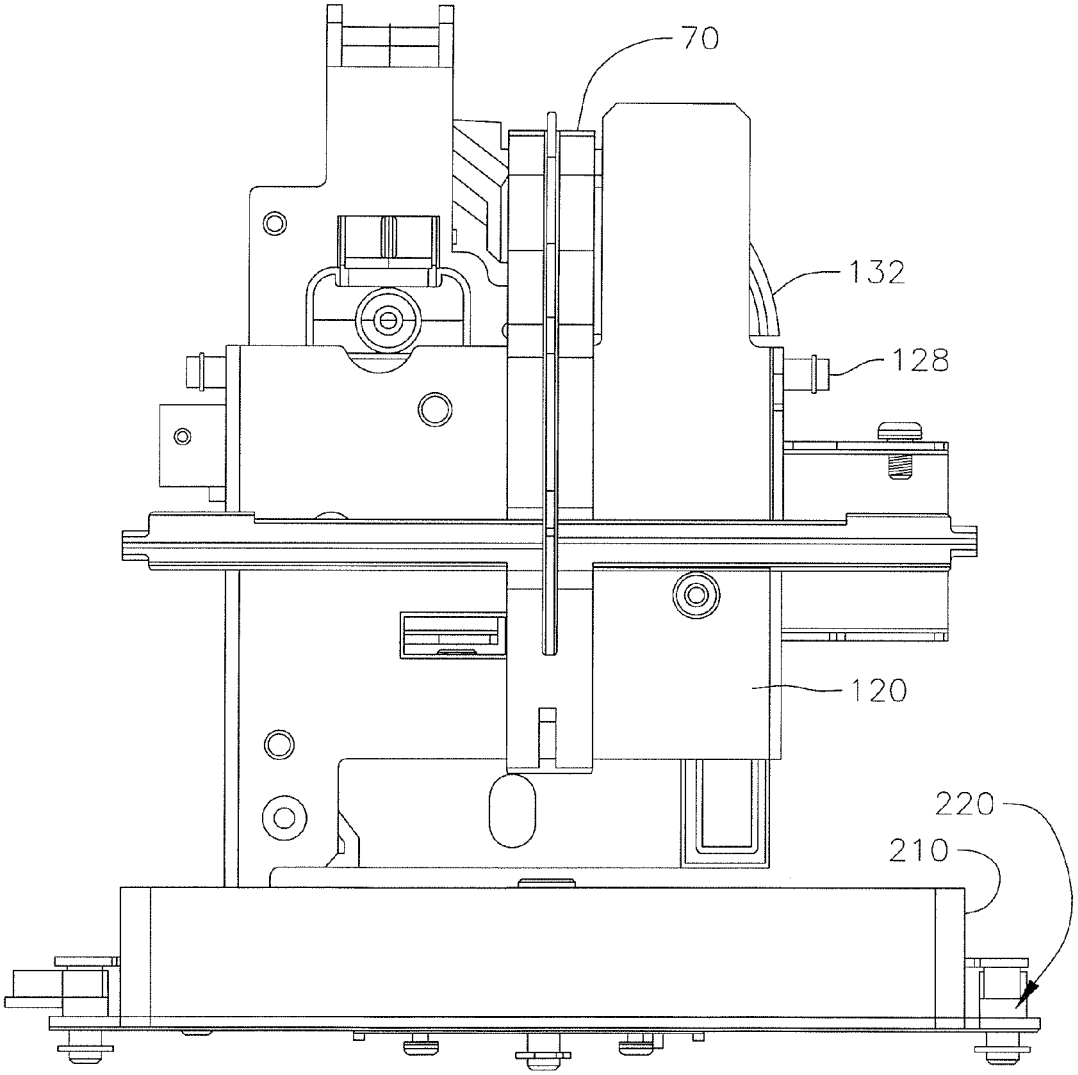
FIG. 19 is a rear view of the coin mechanism and dispense mechanism of FIG. 14.
Figure 20:
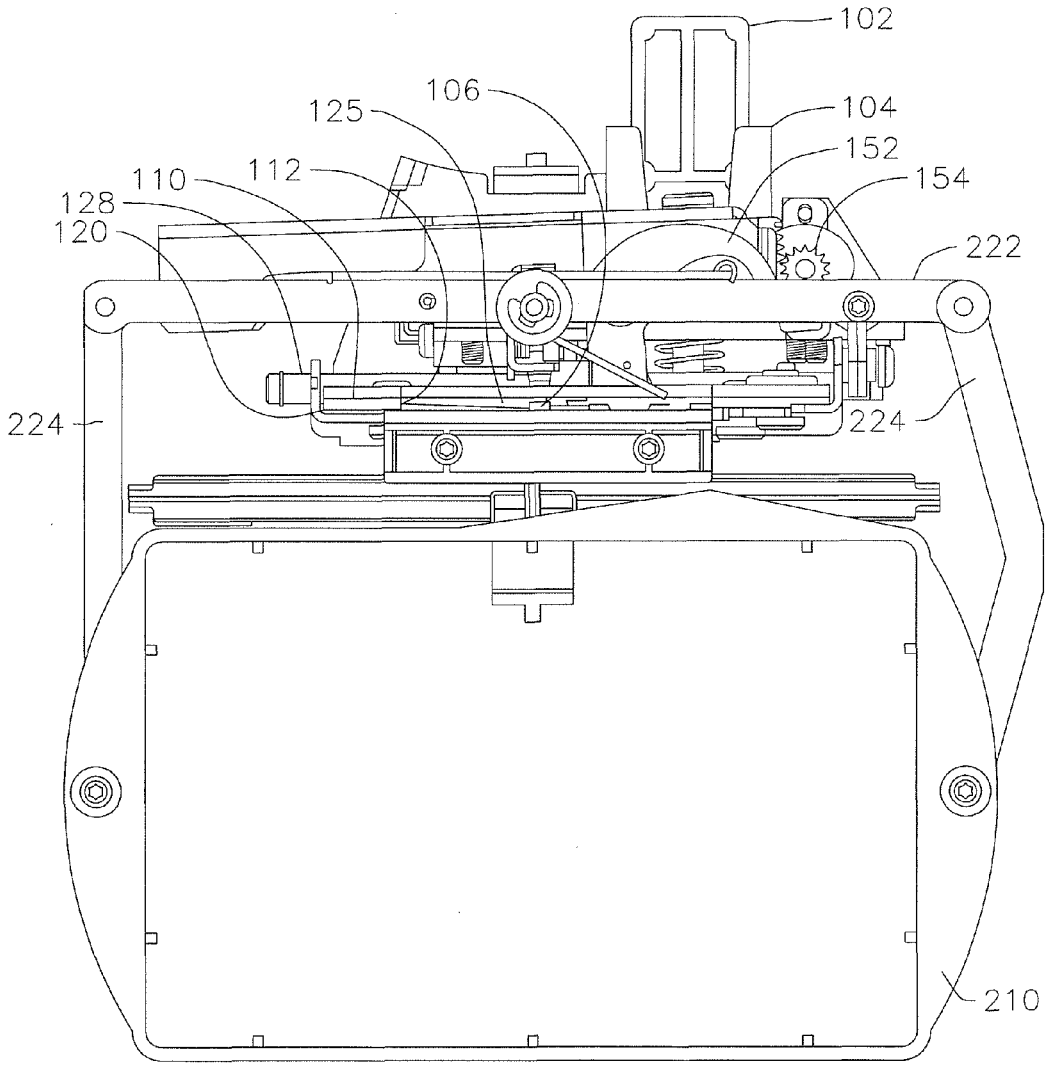
FIG. 20 is a bottom view of the coin mechanism and dispense mechanism of FIG. 14.

With further reference to FIGS. 14-16, the flag member 70 of the first product vending portion 50, in one exemplary embodiment, includes a first portion 72 (e.g., a first end) configured to engage an upper portion of the coin guide 132 (e.g., at the notch 134) and block the coin guide 132 to prevent a user from depositing coins into the coin insertion opening 44 when the first product 12 is no longer available. A second portion 74 (e.g. a second end opposite the first end) of the flag member 70 is configured to abut one of the first products 12 in the first product receptacle 60 for maintaining the flag member 70 in a disengaged position (see FIG. 7), that is, a position which allows a user to deposit a coin into the coin insertion opening 44. Further, in one exemplary embodiment, the flag member 70 further includes a coupling portion 76 between the first and second portions 72, 74 that is rotatably coupled to the platform 80 and is rotatable about a longitudinal axis extending along a length of the coupling portion 76.

Figure 7:
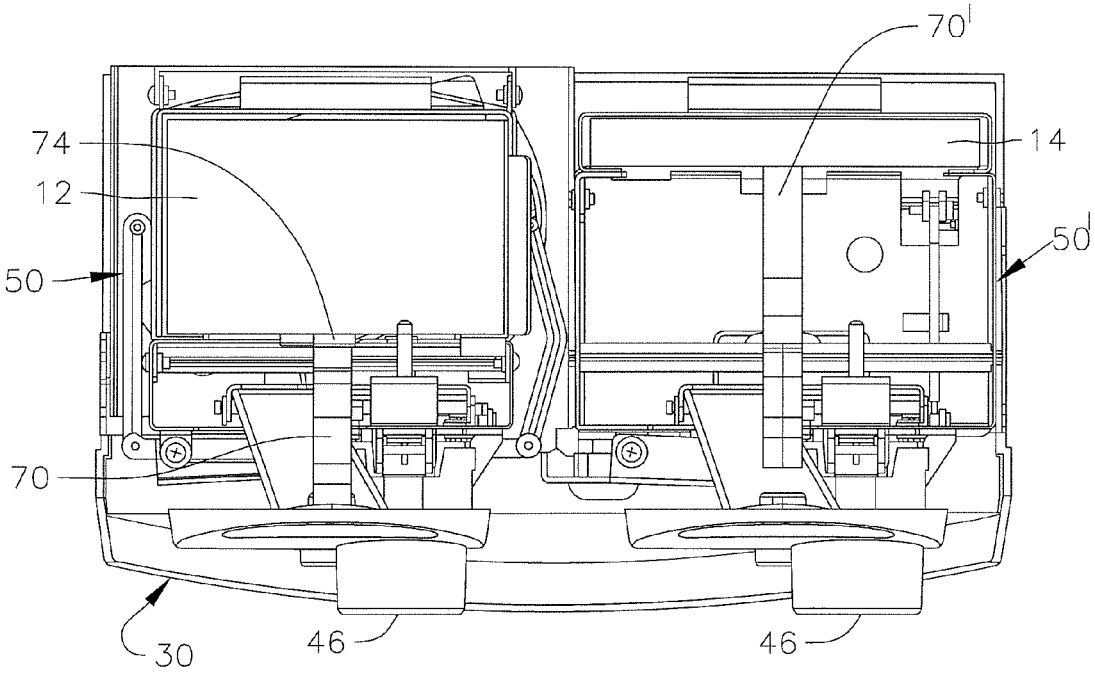
FIG. 7 is a top view of the vending apparatus of FIG. 1 shown with the cabinet assembly removed.
Figure 8:
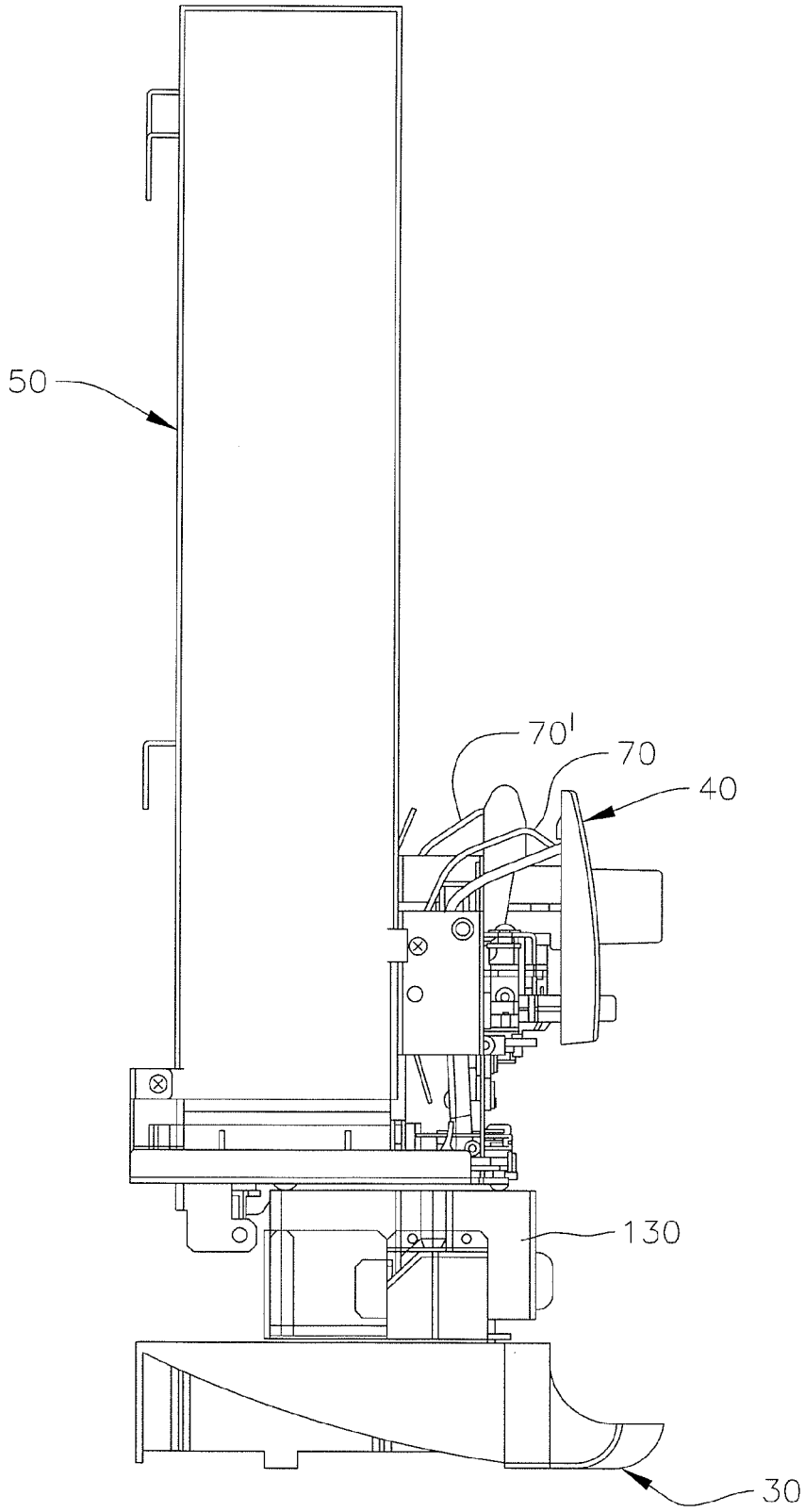
FIG. 8 is a side view of the vending apparatus of FIG. 1 shown with the cabinet assembly removed.

The flag member 70 is shown in FIGS. 14-16 in an engaged position, that is, when the first product 12 is no longer available. In one exemplary embodiment, the flag member 70 is biased toward the engaged position via a spring, gravity, and/or any other suitable biasing mechanism. The flag member 70 is shown in FIG. 7 in the disengaged position. The flag member 70 may be configured such that the second portion 74 abuts the first product 12 to counter the biasing force of the biasing mechanism and thereby retain the flag member 70 in the disengaged position so long as there is an available first product 12 in the first product receptacle 60. Further, in one exemplary embodiment, the flag member 70 is arranged such that the second portion 74 abuts a first product 12 that is stacked immediately above the first product 12 in the discharge chamber 210 so that the flag member 70 will move to the engaged position when there is one first product 12 remaining in the first product vending portion 50 and thereby prevent dispensing of the last remaining first product 12. As such, there will always be a first product 12 remaining in the discharge chamber 210. Such an arrangement facilitates loading of the first product receptacle 60 and reduces the chance of the first product 12 jamming in the first product receptacle 60 or in the discharge chamber 210.

With reference to FIGS. 22-26, according to one exemplary embodiment, the second product vending portion 50' includes many of the same or substantially similar components and structure as described above with respect to the first product vending portion 50. For example, the second product vending portion 50', in one exemplary embodiment, includes the coin mechanism 100 incorporating the delay mechanism 150, as described above with respect to the first product vending portion 50.

Figure 22:
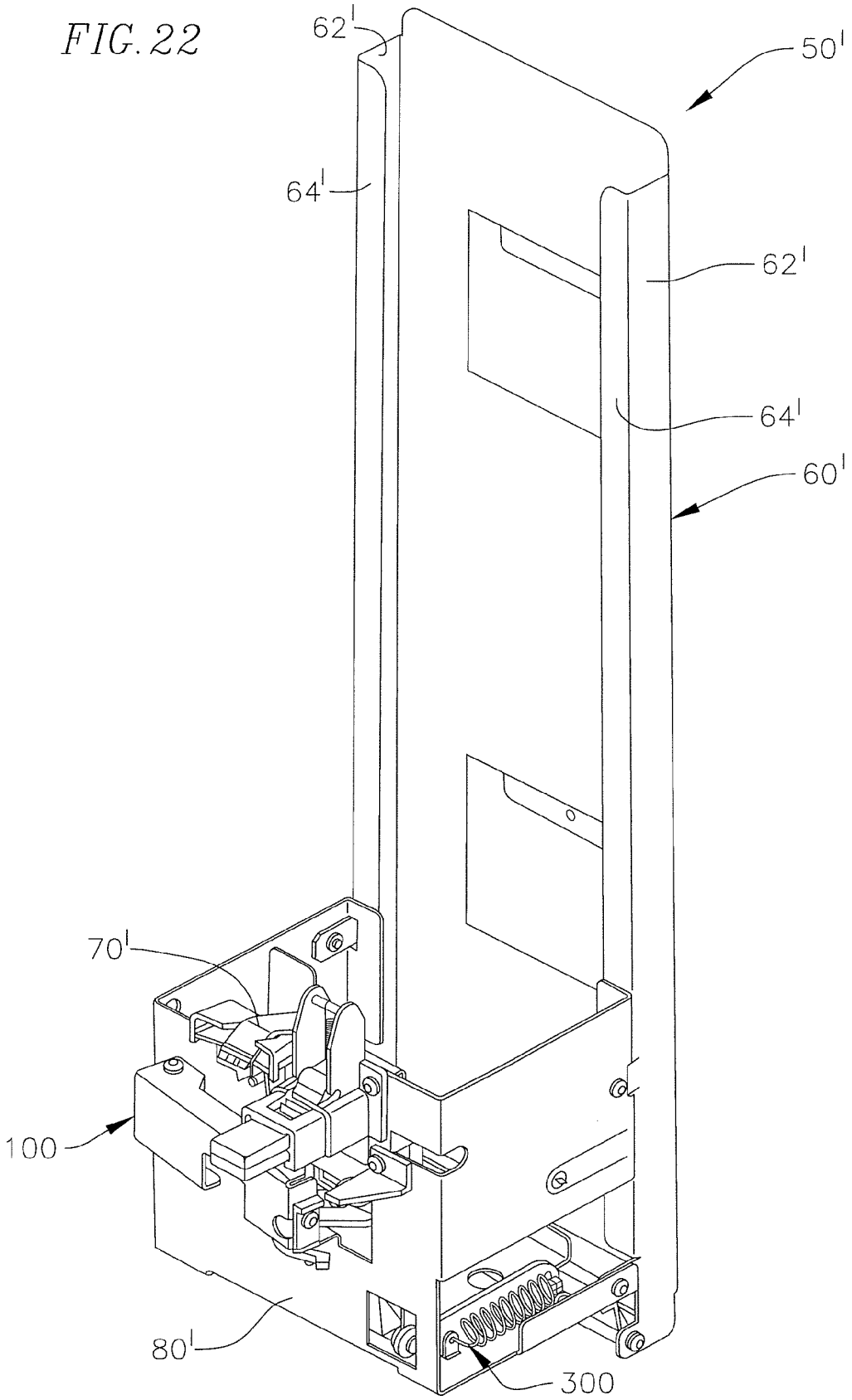
FIG. 22 is a perspective view of a second product vending portion of the vending apparatus of FIG. 1.
Figure 23:
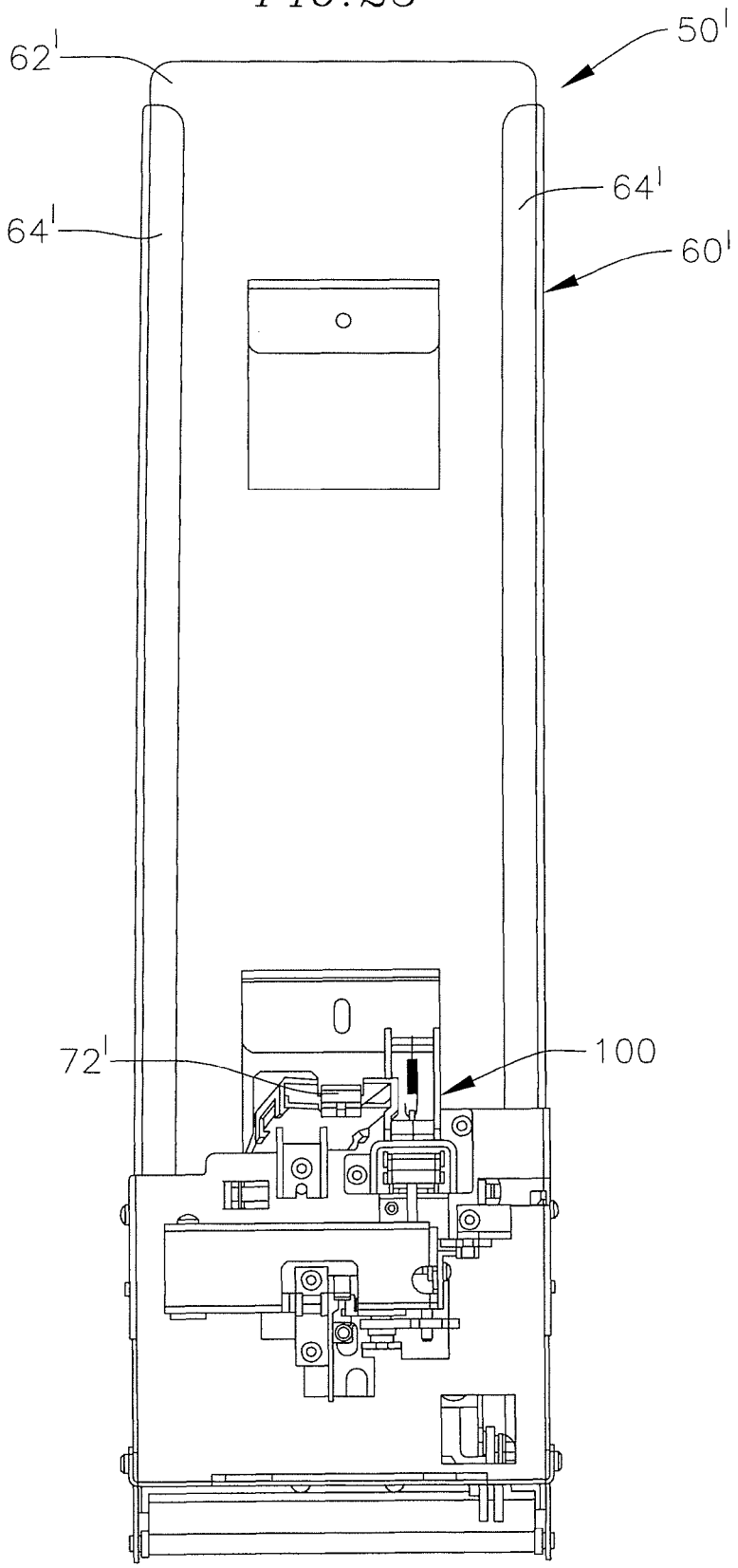
FIG. 23 is a front view of the second product vending portion of FIG. 22.

With further reference to FIGS. 22 and 23, the second product vending portion 50' includes a second product receptacle 60' configured to be loaded with the second product 14 and hold a stack of one or more second products 14 prior to being dispensed to the purchaser. As such, the second product receptacle 60', in one embodiment, is configured to contain a plurality of second products 14 (e.g., second products 14 having a substantially cylindrical shape) stacked one above the other. In one embodiment, as shown in FIGS. 22 and 23, the second product receptacle 60' has vertical walls 62' forming three sides of a rectangle and two flanges 64' protruding from the edges of two opposing walls 62' that are opposite each other to form a portion of the fourth side of the rectangle for retaining the second product 14. Alternatively, the second product receptacle 60' may have any other suitable configuration for holding the second product 14. The second product receptacle 60' may be formed of sheet metal, such as steel or aluminum, or any other suitable material.

In one exemplary embodiment, as shown in FIG. 22, the second product vending portion 50' further includes a platform 80' attached to or integrally formed with the second product receptacle 60' at a lower portion thereof. The platform 80' supports the coin mechanism 100 and a dispense mechanism 300 configured to dispense the second product 14 to a user.

Figure 24:
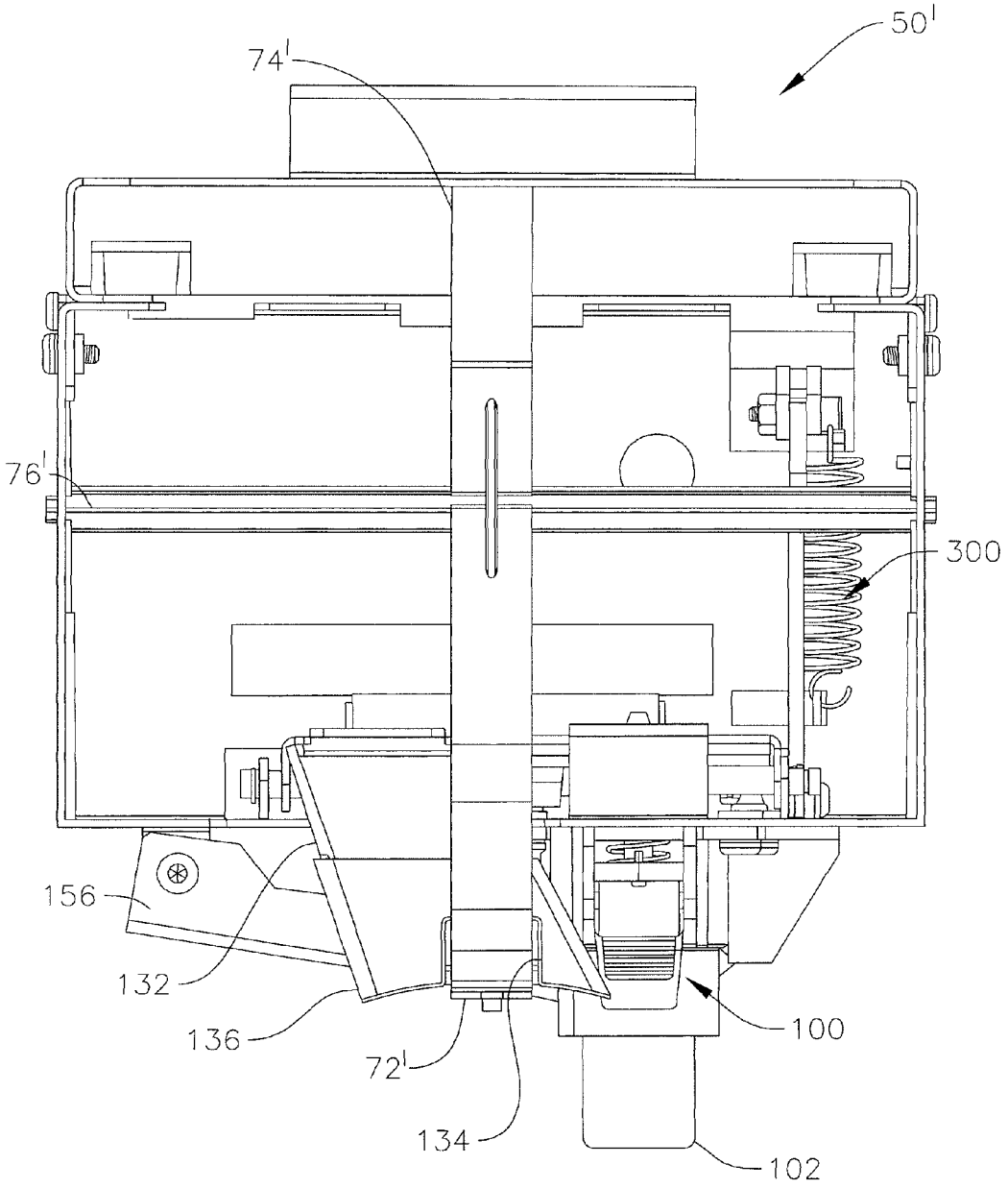
FIG. 24 is a top view of the second product vending portion of FIG. 22.
Figure 25:
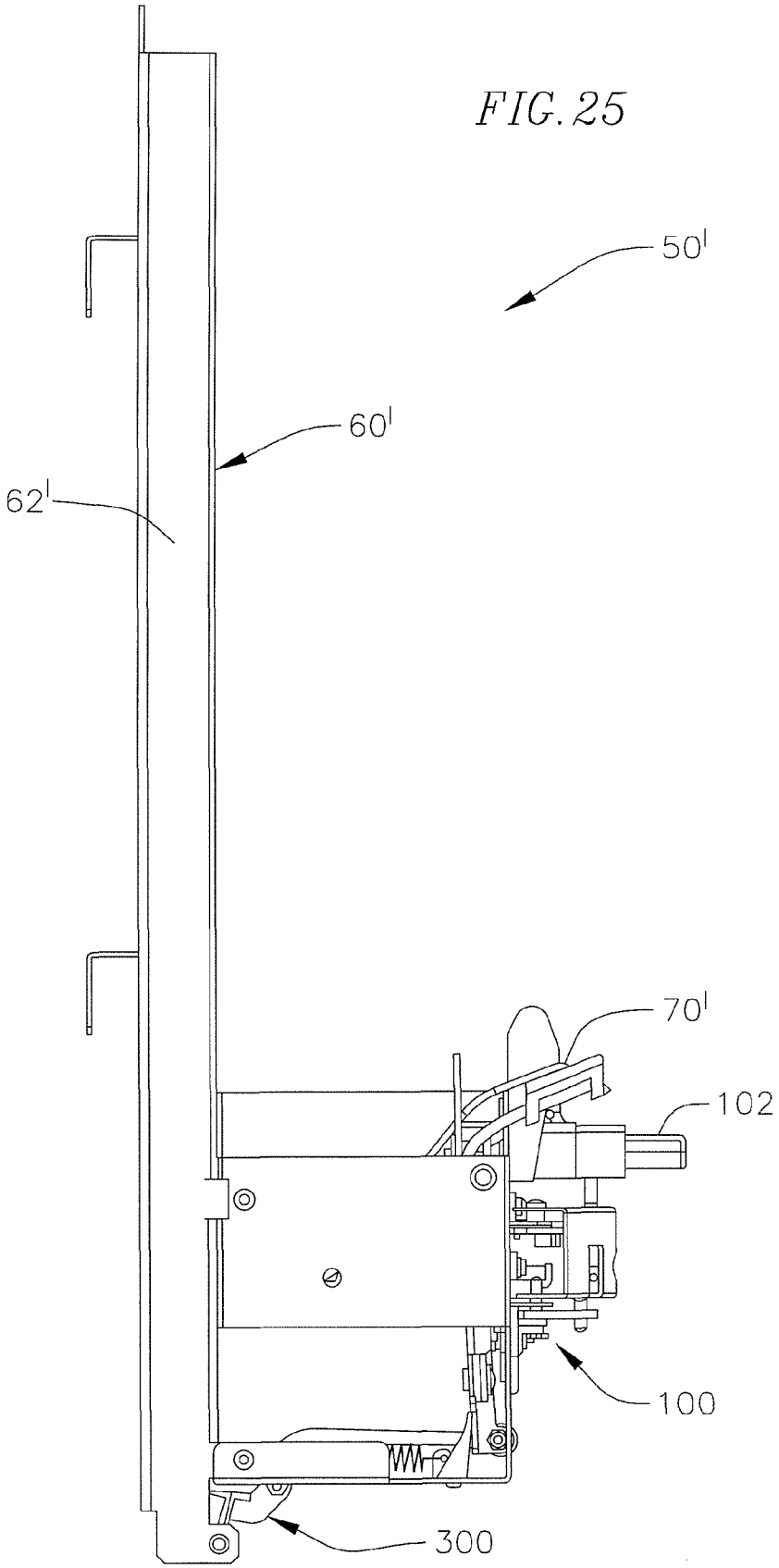
FIG. 25 is a side view of the second product vending portion of FIG. 22.
Figure 26:
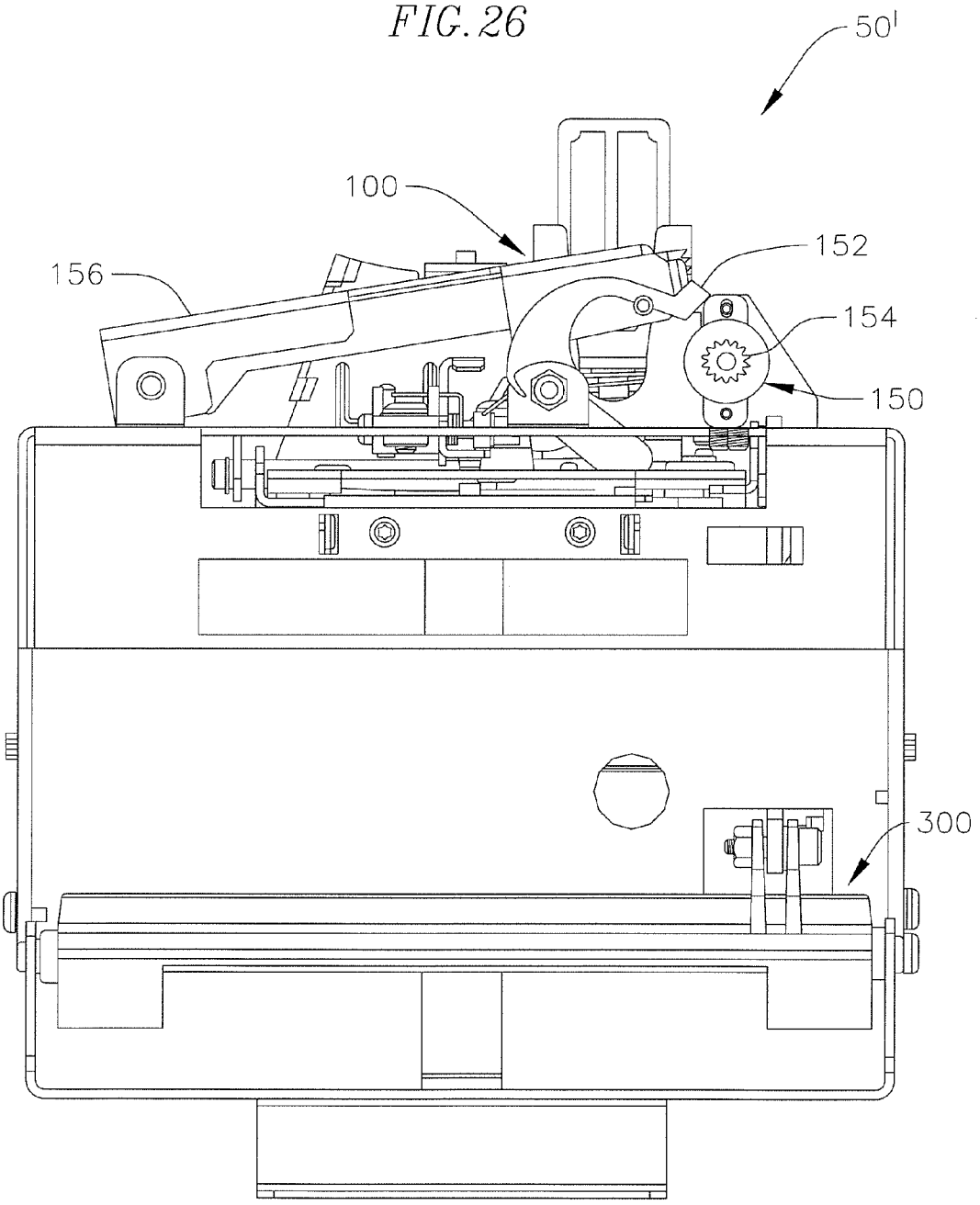
FIG. 26 is a bottom view of the second product vending portion of FIG. 22.

With further reference to FIG. 24, the second product vending portion 50', in one exemplary embodiment, further includes a flag member 70' having a first portion 72' (e.g., a first end) configured to engage an upper portion of the coin guide 132 (e.g., at the notch 134) and block the coin guide 132 to prevent a user from depositing coins into the coin insertion opening 44 when the second product 14 is no longer available. The flag member 70', in one embodiment, is similar to the flag member 70 described above with respect to the first product vending portion 50 but differs in structure at a second portion 74' (e.g., a second end opposite the first end). That is, the second portion 74' of the flag member 70' is configured to abut the second product 14 rather than being configured to abut the first product 12. In one exemplary embodiment, the flag member 70' further includes a coupling portion 76' between the first and second portions 72', 74' that is rotatably coupled to the platform 80' and is rotatable about a longitudinal axis extending along a length of the coupling portion 76'.

In one exemplary embodiment, the flag member 70' is biased toward the engaged position via a spring, gravity, and/or any other suitable biasing mechanism. The flag member 70' may abut the second product 14 to counter the biasing force of the biasing mechanism and thereby retain the flag member 70' in a disengaged position so long as there is an available second product 14 in the second product receptacle 60'. In FIGS. 22-25, the flag is shown in the engaged position, that is, in a position where there is not an available second product 14 remaining. On the other hand, the flag member 70' is shown in FIG. 7 in the disengaged position, that is, in a position where there is at least one available second product 14 remaining. Further, in one exemplary embodiment, the flag member 70' is configured to abut a second product 14 that is stacked immediately above a second product 14 at the bottom of the stack so that the flag member 70' will engage when there is one second product 14 remaining in the second product receptacle 60'.

The dispense mechanism 300 of the second product vending portion 50', in one exemplary embodiment, is connected to the coin mechanism 100 and differs from the dispense mechanism 200 described above with respect to the first product vending portion 50 due to the second product 14 having a different shape and size than the first product 12. For example, the second product 14 may have a substantially cylindrical shape, and the dispense mechanism 300 may include the same or substantially similar components for dispensing the second product 14 as described in U.S. Pat. No. 7,469,779 to Horian, the entire content of which is incorporated by reference herein. Further, the first and second products 12, 14 having a box shape and a cylindrical shape, respectively, and the dispense mechanisms 200, 300 respectively associated therewith, as described herein, are illustrative of some exemplary embodiments, and the present invention is not limited thereto. For example, the coin mechanism 100 may be connected to any of various other dispense mechanisms having a structure differing from the dispense mechanisms 200, 300 for dispensing a product having a size and/or shape differing from that of the first and second products 12, 14.

Although the drawings and accompanying description illustrate exemplary embodiments of a vending apparatus, it will be apparent that the novel aspects of the vending apparatus of the invention may also be carried out by utilizing alternative structures, sizes, shapes, and/or materials in embodiments of the vending apparatus of the present invention. Embodiments of the vending apparatus may also, for example, be adapted for use by various market sectors.

The preceding description has been presented with reference to various embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. A vending apparatus comprising a dispense mechanism configured to dispense a product without requiring electricity, the dispense mechanism comprising:

a platform having an opening for dispensing said product therethrough;

a coin mechanism for receiving at least one coin and releasing such coin to a coin bank before the vending apparatus dispenses the product, the coin mechanism comprising a first member and a second member and being supported by said platform and extending above said platform opening;

an actuator mechanically activated by a push button and moveable back and forth between an unactuated position and an actuated position for causing dispensing of the product;

a delay mechanism for delaying a return of said actuator to the unactuated position from the actuated position for ensuring that all of the at least one coin received by the coin mechanism for dispensing a product is released before the actuator returns to the unactuated position; and a chamber below said coin mechanism and above said platform for receiving the product, said chamber being mechanically linked by at least one linking member with at least one of the first and second members of the coin mechanism, said chamber being rotatable by at least one of said at least one linking member relative to the platform opening for rotating and aligning the product with the platform opening and dispensing the product therethrough when at least one of the first and second members is moved.

2. The vending apparatus of claim 1, further comprising a product receptacle for containing the product, said product receptacle comprising walls for receiving the product therebetween, and wherein the chamber is rotatable relative to the platform opening from a first position wherein walls of the chamber are substantially aligned with walls of the product receptacle and are not substantially aligned with edges of the platform opening to a second position wherein the walls of the chamber are not substantially aligned with the walls of the product receptacle and are substantially aligned with the edges of the platform opening for allowing the product to drop through the platform opening.

3. The vending apparatus of claim 2, wherein the walls of the chamber have a height that is less than a height of the product received in the chamber, the height of the product being measured in a same direction as the height of the walls of the chamber.

4. The vending apparatus of claim 1, wherein the coin mechanism first and second members define a coin slot therebetween for receiving the at least one coin, and wherein the delay mechanism comprises a cam and a damper.

5. The vending apparatus of claim 1, wherein the actuator is moveable back to the unactuated position without any further input from a user.

6. The vending apparatus of claim 1 wherein the delay mechanism comprises:

an actuation lever, said actuation lever being moved to a first position when said actuator is in the unactuated position and being moved to a second position when said actuator is in the actuated position; and a damper being engageable by said actuation lever for slowing movement of the actuation lever to the first position.

7. The vending apparatus of claim 6 wherein the delay mechanism further comprises a cam, said cam being biased by a biasing member towards an actuated position, wherein when in said actuated position said cam prevents said actuator from being moved back to the unactuated position, said cam being releasable from said biasing member by said actuation lever allowing said actuator to move to the unactuated position and the actuation lever to move to the first position.

8. The vending apparatus of claim 1, wherein a coin slot is defined between the first and second members for receiving the at least one coin therebetween.

9. A method of vending a product without requiring electricity utilizing a vending apparatus having a coin mechanism for receiving at least one coin and releasing said at least one coin to a coin bank before the vending apparatus dispenses the product and including an actuator moveable back and forth between an unactuated position and an actuated position for causing dispensing of the product, the coin mechanism comprising a first member and a second member, the method comprising:

pressing a button for mechanically moving the actuator from the unactuated position to the actuated position for dispensing the product from the vending apparatus when the at least one coin is inserted into the slot;

releasing all of said at least one coin to the coin bank;

returning the actuator from the actuated position to the unactuated position after all of said at least one coin has been released to the coin bank;

moving at least one of the first and second members; and mechanically activating a dispenser for vending the product by rotating the product at a location below the coin mechanism to align the product with a discharge opening of the vending apparatus whereby the product is dispensed through the discharge opening.

10. The method of claim 9 further comprising delaying the return of the actuator from the actuated position to the unactuated position for allowing all of said at least one coin to be released into a coin bank.

11. The method of claim 9, wherein a coin slot is defined between the first and second members for receiving the at least one coin therebetween.

12. The method of claim 9, wherein apparatus further comprises a delay mechanism comprising a cam and a damper.

13. The method of claim 12, wherein the delay mechanism is configured to slow a return of the actuator from the actuated position back to the unactuated position.

* * * * *